United States Patent [19]

Morimoto et al.

[11] Patent Number: 4,586,863

[45] Date of Patent: May 6, 1986

[54] APPARATUS FOR SHAPING AN METALLIC PULL RING AND SIMULTANEOUSLY CONNECTING IT TO A CONTAINER CLOSURE

[75] Inventors: Kenji Morimoto, Tokyo; Tamotsu Ikegami, Yokohama; Masao Naito, Kanagawa; Tateo Kubo, Hiratsuka; Shinichi Kizawa, Yokohama, all of Japan

[73] Assignee: Toyo Seikan Kaisha, Ltd., Tokyo, Japan

[21] Appl. No.: 599,666

[22] Filed: Apr. 12, 1984

[30] Foreign Application Priority Data

| | | | |
|---|---|---|---|
| Apr. 15, 1983 | [JP] | Japan | 58-65285 |
| Apr. 15, 1983 | [JP] | Japan | 58-65286 |
| Apr. 15, 1983 | [JP] | Japan | 58-65287 |
| Apr. 15, 1983 | [JP] | Japan | 58-65288 |
| Apr. 15, 1983 | [JP] | Japan | 58-652289 |
| Apr. 15, 1983 | [JP] | Japan | 58-65290 |
| Apr. 15, 1983 | [JP] | Japan | 58-65291 |

[51] Int. Cl.[4] ..... B21D 51/44

[52] U.S. Cl. ..... 413/14; 413/25; 413/66

[58] Field of Search ..... 413/14, 16, 25, 66, 413/15, 64, 67; 72/405; 215/255, 250

[56] References Cited

U.S. PATENT DOCUMENTS

| | | | |
|---|---|---|---|
| 3,952,900 | 4/1976 | Rausing | 215/255 |
| 4,037,551 | 7/1977 | Lewis | 413/16 |
| 4,341,498 | 7/1982 | Ellis | 413/64 |
| 4,453,644 | 6/1984 | Berglund | 215/255 |

OTHER PUBLICATIONS

Japanese Laid-Open Patent Publication, 8/18/1984, Inventor=Sjogren et al., Laid-Open Publn. Nos.: 144537/84, 144536/84.

*Primary Examiner*—Francis S. Husar
*Assistant Examiner*—Robert Showalter
*Attorney, Agent, or Firm*—Young & Thompson

[57] ABSTRACT

An apparatus for shaping a metallic pull ring and simultaneously connecting it to a container closure is disclosed. The apparatus includes a pre-shaped article former for shearing with a rotary shearing blade a rectangular metal blank from the end portion of a thin metal strip and simultaneously blending it to form an annular pre-shaped article having overlapped opposite ends, a closure feeder as well as a pre-shaped article feeder for continuously positioning a container closure and the pre-shaped article to a rotating support member in such a relation that the free end portion of a tear-off tab of the closure and a part of the pre-shaped article overlap each other and a pull ring shaper and connecter for curling the peripheral edge of the pre-shaped article in the radial direction to form it into a ring and simultaneously rolling the tear-off tab into said ring and connecting them to each other.

21 Claims, 36 Drawing Figures

APPARATUS FOR SHAPING AN METALLIC PULL RING AND SIMULTANEOUSLY CONNECTING IT TO A CONTAINER CLOSURE

FIELD OF THE INVENTION

This invention relates to an apparatus for shaping a metallic pull ring and simultaneously connecting the same to a container closure.

BACKGROUND OF THE INVENTION

In recent years, there have come into widespread use container closures in which a tear-off weakened line leading from a tear-off tab projecting from the skirt portion to the top surface of a closure is provided in the closure body so as to permit simple opening by pulling the tear-off tab. Since a considerable force must be exerted in pulling up the tear-off tab in opening a container closure of this type, measures have been taken to make the opening easy by providing a long tear-off tab, or by attaching suitable gripping piece. These measures, however, have the defect that many wastes are generated in the pre-shaping of a container closure from a thin metal strip, and therefore the cost of the closure increases.

Many methods have also been proposed for separately producing a gripping piece and connecting it to the tear-off tab by such means as bonding, rivetting or scissoring hold. These methods, however, have the disadvantage that much labor and time are required during the manufacturing process, the connecting portion is weak and causes troubles such as breaking before opening, and moreover the cost of production markedly increases.

In order to overcome these problems, Wicanders AB of Sweden has developed and filed patent applications No. 13855/1983 and No. 13856/1983 in Japan for a method and an apparatus therefor, of producing a container closure equipped with a metallic pull ring on a mass production basis at low cost which comprises forming an annular article having both ends overlapping each other by cutting a rectangular metal blank from the end portion of a thin metal strip and simultaneously bending it, positioning the annular article and a container closure such that a free end portion of a tear-off tab of the closure and a part of the annular article may overlap each other, curling the peripheral edge of the annular article in the radial direction to form a ring and simultaneously rolling the tear-off tab into the ring to connect them to each other.

This type of container closure equipped with a metallic pull ring, for example, has a structure as shown in FIG. 1. This container closure can be continuously shaped by an apparatus which is comprised basically of (1) a pre-shaped article forming means for cutting a thin metal strip to form an annular pre-shaped article, (2) a pre-shaped article feeding means for feeding the pre-shaped article to a position at which it is in communication with a tear-off tab of the closure, (3) a closure feed means and (4) a pull ring shaping and connecting means for shaping the pre-shaped article abutting against the tab of the closure into a pull ring and simultaneously connecting it to the closure.

In order to obtain a closure equipped with a metallic pull ring having stable quality at low cost, it is necessary to shape the annular pre-shaped article at sufficiently high speeds into a pull ring to connect it to a tear-off tab of the closure securely.

SUMMARY OF THE INVENTION

Accordingly, an object of this invention is to improve the pre-shaped article forming means for cutting a thin metal strip into an annular pre-shaped article in the pull ring shaping and connecting apparatus of the aforesaid construction in order to meet the aforesaid need.

For the foregoing purpose, the invention provides an apparatus for shaping a metallic pull ring and simultaneously connecting it to a container closure comprising a pre-shaped article forming means for forming an annular pre-shaped article having both ends overlapping each other by shearing a rectangular metal blank from the end portion of a thin metal strip and simultaneously bending it and pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other; characterized in that said pre-shaped article forming means includes a metal strip feeding means for intermittently feeding the thin metal strip in its longitudinal direction by a distance corresponding with the widthwise size of the rectangular metal blank, a stationary shearing tool having a single stationary shear blade and a movable shearing tool having a plurality of shearing blades mounted on a rotating support member at predetermined intervals in the circumferential direction and adapted to act in cooperation with the stationary shearing blade and gradually shear the longitudinally forward end portion of the thin metal strip from one side edge to the other side edge and simultaneously bend it in the widthwise direction. Another object of this invention is to improve the pre-shaped article feed means for feeding the pre-shaped article formed by shearing a rectangular metal blank to position the pre-shaped article and a container closure in such a relation that a part of the pre-shaped article and the free end portion of a tear-off tab of the closure overlap each other in the pull ring shaping and connecting apparatus of aforesaid construction in order to meet the aforesaid need.

For the foregoing purpose, the invention further provides an apparatus for shaping a metallic pull ring and simultaneously connecting it to a container closure comprising: pre-shaped article forming means for forming an annular pre-shaped article having both ends overlapping each other by shearing a rectangular metal blank from the end portion of a thin metal strip and simultaneously bending it, pull ring shaping and connecting means for positioning a container closure and the pre-shaped article in such a relation that the free end portion of tear-off tab of the closure and a part of the pre-shaped article overlap each other, means for curling the peripheral edge of the pre-shaped article in the radial direction to form it into a ring and simultaneously rolling the tear-off tab into said ring and connecting them to each other, and pre-shaped article feed means for feeding the pre-shaped article formed by the pre-shaped article forming means to a predetermined position of the pull ring shaping and connecting means, characterized in that said pre-shaped article feed means includes a rotating support member and a plurality of holding members circumferentially spaced at predetermined intervals on the rotating support member, and each of said holding members has at its radially outward end portion a cut and holding means for holding the pre-shaped article and is constructed such that the pre-shaped article is conveyed through a pre-shaped article holding zone in which the pre-shaped article is received from the pre-shaped article forming means and a pre-shaped article receiving zone in which the pre-shaped article is delivered to the pull ring shaping and connecting means.

The rotating support member of the pre-shaped article feed means is adapted to rotate about a substantially vertical axis, while the holding means provided in the holding member of the pre-shaped article feed means is composed of a magnet which attracts and holds the pre-shaped article made of a magnetic metal by the action of a magnetic force and further the holding means is constructed of a suction holding means for holding the pre-shaped article by a vacuum action.

The cut provided at the radially outward end portion of the holding member of the pre-shaped article feed means is constructed such that it receives and holds the outside surface of that portion of the pre-shaped article which is other than the overlapping end portions.

A further object of this invention is to improve the closure feed means for feeding closure having a tear-off tab to which a pull ring is connected in the pull ring shaping and connecting apparatus of the aforesaid construction in order to meet the aforesaid need.

For this purpose, the invention provides an apparatus for shaping metallic pull ring and simultaneously connecting it to a container closure comprising pre-shaped article forming means for forming an annular pre-shaped article having both end portions overlapping each other by shearing a rectangular metal blank from the end portion of a thin metal strip and simultaneously bending it, pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other, and closure feed means for feeding the closure to a predetermined position of the pull ring shaping and connecting means, characterized in that the closure feed means includes a rotating conveyor disc adapted to rotate about a substantially vertical axis and having formed on its peripheral surface a plurality of circumferentially spaced closure receiving pockets opened radially outwardly and vertically upwardly, a closure feed chute for feeding the closure into each of said pockets from above in a vertical direction in a closure holding zone, and an arcuate stationary guide rail extending along the peripheral surface of the rotating conveyer disc over a range at least from the closure holding zone to the closure receiving zone of the pull ring shaping and connecting means, said closure feed chute being provided at the central portion of its front wall with an open groove for feeding and guiding the closure while allowing the outside surface of the top panel wall of the closure to abut against the rear wall of the chute and positioning the tear-off tab uppermost in the vertical direction, and the stationary guide rail being provided therein with an inner surface with which the lower edge of the skirt wall of the closure received in the pocket makes contact and a top surface with which the inner surface of the base portion of the tear-off tab makes contact.

The closure feed chute has provided therein a pin projecting into the skirt wall of the closure to prevent the downward movement of the closure, said pin being movable with respect to said open groove provided in the central portion of its front wall.

A still further object of this invention is to improve the pull ring shaping and connecting means which receives a pre-shaped article formed by shearing a rectangular metal blank and a closure having a tear-off tab, positions the pre-shaped article and the closure in a predetermined relation, forms the pre-shaped article into a pull ring and simultaneously connects the pull ring to the tear-off tab of the closure in the pull ring shaping and connecting apparatus of aforesaid construction in order to meet the aforesaid need.

For the foregoing purpose, the invention provides an apparatus for shaping a metallic pull ring and simultaneously connecting it to a container closure comprising a pre-shaped article forming means for forming an annular pre-shaped article having both end portions overlapping each other by shearing a rectangular metal blank from the end portion of a thin metal strip and simultaneously bending it and pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other, characterized in that said pull ring shaping and connecting means includes a rotating support member to be continuously rotated and a plurality of pull ring shaping and connecting units circumferentially spaced at predetermined intervals on the rotating support member, and is constructed such that each of the pull ring shaping and connecting units is conveyed by the rotation of the rotating support member successively through a pre-shaped article receiving zone, a closure receiving zone and a rolling zone, the pre-shaped article is fed to the pull ring shaping and connecting unit in said pre-shaped receiving zone, the closure is fed to the pull ring shaping and connecting unit in said closure receiving zone, and the curling and rolling connections are carried out in said rolling zone.

Each of the pull ring shaping and connecting units includes a vertical mandrel comprised of a lower mandrel member and an upper mandrel member disposed in vertical alignment, at least one of the lower and upper mandrel members being free to move up and down, and wherein in the pre-shaped article receiving zone, the pre-shaped article is conveyed by the pre-shaped article feed means to the space between the upper mandrel member and the lower mandrel member spaced verically from each other, and by lowering the upper mandrel member and/or raising the lower mandrel member, the pre-shaped article is put over the vertical mandrel.

Furthermore, the upper mandrel member has a cylindrical main portion and a nearly conical lower end portion and the lower mandrel member has a cylindrical main portion and a nearly conical upper end portion, the outside diameter of the main portion of the upper mandrel member being substantially equal to that of the main portion of the lower mandrel member and the lower end portion of the upper mandrel member and the upper end portion of the lower mandrel member having complementary cuts formed therein, and when the upper mandrel member is lowered and/or the lower mandrel member is raised, the main portion of the upper mandrel member is combined with the main portion of the lower mandrel member to form a substantially continuous cylindrical vertical mandrel.

Moreover, the vertical mandrel has provided at its periphery an upper annular rolling tool and a lower annular rolling tool which are free to move up and down, and before the pull ring shaping and connecting unit reaches the closure receiving zone after passage through the pre-shaped article receiving zone, the upper annular rolling tool is lowered to a predetermined position to lower the lower edge of the pre-shaped article put over the vertical mandrel to a position at which it abuts against the lower annular rolling tool, and after passage through the closure receiving zone, the upper annular rolling tool is lowered to deform the pre-shaped article and the free end portion of the tear-off tab of the closure simultaneously in cooperation with the lower annular rolling tool.

Again, each of the pull ring shaping and connecting units includes a hammer means which, after each said pull ring shaping and connecting unit has passed through the closure receiving zone and before it enters the rolling zone, presses the free end portion of the tear-off tab against the surface of the vertical mandrel and a part of the pre-shaped article overlapping said free end portion of the tear-off tab, thereby bending the free end portion of the tear-off tab in its widthwise direction to a curvature substantially equal to the curvature of the pre-shaped article in its longitudinal direction.

A further object of this invention is to improve the closure transfer means for transferring a closure having a pull ring connected thereto from the pull ring shaping and connecting means to the connection strengthening means in the pull ring shaping and connecting apparatus of the aforesaid construction in order to meet the aforesaid need.

For the foregoing purpose, the invention provides an apparatus for shaping a metallic pull ring and simultaneously connecting it to a container closure comprising a pre-shaped article forming means for forming an annular pre-shaped article having both ends overlapping each other by shearing a rectangular metal blank from the end portion of a thin metal strip and simultaneously bending it, a pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other, and a means for transferring through the closure transfer means the closure having the pull ring connected to the free end portion of the tear-off tab and pressing and deforming the connected portion between the closure and the pull ring to strengthen their connection, characterized in that said closure transfer means includes a rotating transfer disc provided rotatably about a substantially vertical axis, a plurality of closure receiving pockets opened radially outwardly and vertically upwardly and spaced circumferentially on the peripheral surface of the rotating transfer disc at predetermined intervals, and a stationary guide rail extending along the peripheral surface of the rotating transfer disc at least over a range from the discharging zone of the pull ring shaping and connecting means to the transfer zone of the connection strengthening means, and the stationary guide rail has provided therein an inner surface with which the lower edge of the skirt wall of the closure having the pull ring connected thereto and received in said pocket makes contact and a top surface with which the base portion of the tear-off tab and the radially inside portion of the pull ring make contact.

Another object of this invention is to improve the connection strengthening means for strengthening the connected part between a closure and a pull ring in the closure having the pull ring connected thereto in the pull ring shaping and connecting apparatus of the aforesaid construction in order to meet the aforesaid need.

For this purpose, the invention provides an apparatus for shaping a metallic pull ring and simultaneously connecting it to a container closure comprising a pre-shaped article forming means for forming an annular pre-shaped article having both ends overlapping each other by shearing a rectangular metal blank from the end portion of a thin metal strip and simultaneously bending it, pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other, and means for pressing and deforming the connected portion between the pull ring and the free end portion of the tear-off tab of the closure to strengthen their connection, characterized in that said connection strengthening means includes a rotating support member provided rotatably about a substantially vertical axis and a plurality of connection strengthening units spaced circumferentially at predetermined intervals on the rotating support member, each of said connection strengthening units including a supporting block having a radially outwardly and vertically upwardly opened pocket for receiving the closure and the pull ring connected to it, and an upper pressing tool and a lower pressing tool provided in vertical alignment, and the connected part between the closure and the pull ring in the pocket is pressed and deformed by the cooperation of the upper and lower pressing tools.

A still further object of this invention is to provide a means for detecting the failure of feeding closure and the failure of connecting between the closure and a pull ring and a means for rejecting the closure or a pre-shaped article to be formed into the pull ring before connecting them in the pull ring shaping and connecting apparatus of the aforesaid construction in which the pre-shaped article from the pre-shaped feed means and the closure from the closure feed means are positioned in predetermined relation, and the pre-shaped article is formed into the pull ring and simultaneously connected to the closure by the pull ring shaping and connecting means.

For the foregoing purpose, the invention provides an apparatus for shaping a metallic pull ring and simultaneously connecting it to a container closure comprising pre-shaped article forming means for forming an annular pre-shaped article having both ends overlapping each other by shearing a rectangular metal blank from the end portion of a thin metal strip and simultaneously bending it, pull ring shaping and connecting means for positioning a container closure and the pre-shaped article in such a relation that the free end portion of a tear-off tab of the closure and a part of the pre-shaped article overlap each other, curling the peripheral edge of the pre-shaped article in the radial direction to form it into a ring and simultaneously rolling the tear-off tab into said ring and connecting them to each other, pre-shaped article feed means for feeding the pre-shaped article formed by the pre-shaped article forming means to a predetermined position of the pull ring shaping and connecting means, closure feed means for feeding the closure to a predetermined position of the pull ring shaping and connecting means, and connection strengthening means for transferring the closure having the pull ring connected to the free end portion of its tear-off tab and pressing and deforming the connected part between the closure and the pull ring to strengthen their connection, characterized in that it further comprises a sensing means for detecting the failure of feeding the closure provided at a part of the closure feed means and a rejecting means for rejecting the pre-shaped article provided at a part of the pre-shaped article feed means, and in the event that a certain pull ring shaping and connecting unit in the pull ring shaping and connecting means should fail to receive the closure owing to the non-conveyance of the closure by the closure feed means to the closure receiving zone, the rejecting means is actuated to keep the pre-shaped article from being conveyed to the pre-shaped article receiving zone and thus make said certain pull ring shaping and connecting unit unable to receive the pre-shaped article in the pre-shaped article receiving zone.

The rejecting means for rejecting an independently shaped pull ring is provided in a part of the pull ring shaping and connecting means and a sensing means for simultaneously detecting the closure and the pull ring connected to it is provided in a part of the closure transfer means.

The invention will be described in more detail for the preferred embodiments with reference to the accompanying drawings.

PREFERRED EMBODIMENT OF THE INVENTION

Figure 1:
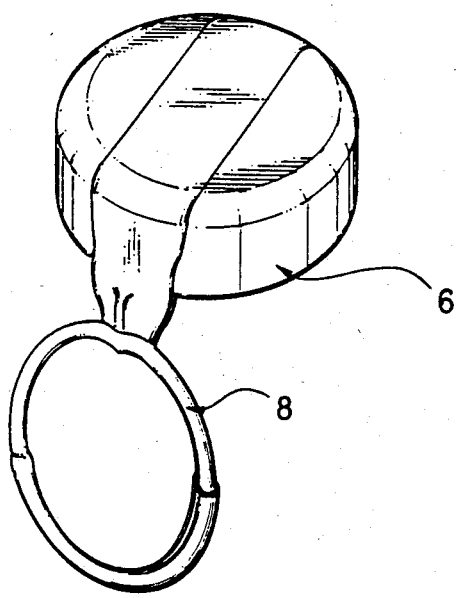
FIG. 1 is a perspective view of a container closure equipped with a metallic pull ring manufactured by the apparatus of this invention.

The preferred embodiments of the apparatus in accordance with this invention are described below.

The general basic construction of the apparatus for shaping and connecting a metallic pull ring 8 in a container closure 6 (FIG. 1) in accordance with this invention will first be described with reference to FIG. 2.

The apparatus of this invention includes pre-shaped article forming means 10, pre-shaped article feed means 12, closure feed means 14, pull ring shaping and connecting means 16, closure transfer means 18 and connection strengthening means 20. The functions and operations of these means are briefly described blow.

The pre-shaped article forming means 10 cuts a rectangular metal blank from a thin metal strip of chromate-treated steel, tin plate, aluminum alloys, etc. and simultaneously bends it in the longitudinal direction to form a nearly annular pre-shaped article having both ends overlapping each other. The pre-shaped article feed means 12 receives the pre-shaped article formed by the pre-shaped article forming means 10 in holding zones A and B, conveys it in the direction of the arrow shown within the article feed means 12 and delivers it to a pre-shaped article receiving zone C. On the other hand, the closure feed means 14 receives a closure in a holding zone D, conveys it in the direction of the arrow shown within the closure feed means 14, and delivers it to a closure receiving zone E. The pull ring shaping and connecting means 16 receives the pre-shaped article from the pre-shaped article feed means 12 in the pre-shaped article receiving zone C, conveys it in the direction of the arrow shown within said shaping and connecting means 16 in FIG. 2, then receives the closure from the closure feed means 14 at the closure receiving zone E, and positions the closure and the pre-shaped article so that a tab of the closure and a part of the pre-shaped article may overlap each other. Thereafter, it curls the peripheral edge of the pre-shaped article in the radial direction in a bending zone F to form the pre-shaped article into a ring, and simultaneously rolls the tab of the closure into the ring in a pull ring shaping and connecting zone G to connect them to each other, and delivers the ring-equipped closure to a discharge zone H.

Figure 2:
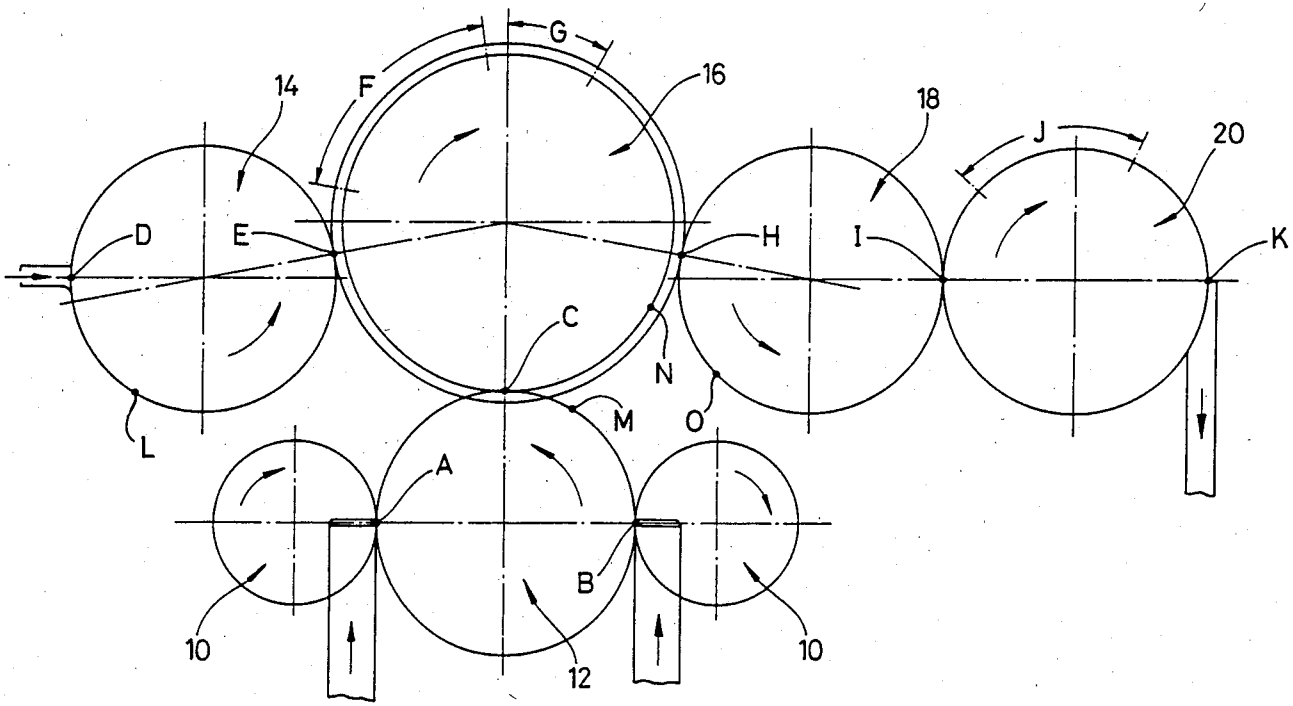
FIG. 2 is a diagrammatic view showing the manufacturing process of a container closure equipped with a metallic pull ring shown in FIG. 1.

The closure transfer means 18 receives the closure having the pull ring connected thereto from the pull ring shaping and connecting means 16 in the discharge zone H, conveys it in the direction of the arrow shown with the closure transfer means 18 in FIG. 2, and delivers it to a transfer zone I. The connection strengthening means 20 receives the closure having the pull ring connected thereto from the closure transfer means 18 at the transfer zone I, conveys it in the direction of arrow, presses and deforms the connected part between the tab of the closure and a part of the pull ring to strengthen the connected part (refer to FIG. 1) in a pressing and deforming zone J, and delivers it to a discharge zone K.

With reference to FIGS. 3 to 8, the pre-shaped article forming means 10 which forms an important part of the apparatus of this invention will now be described in detail.

Figure 3:
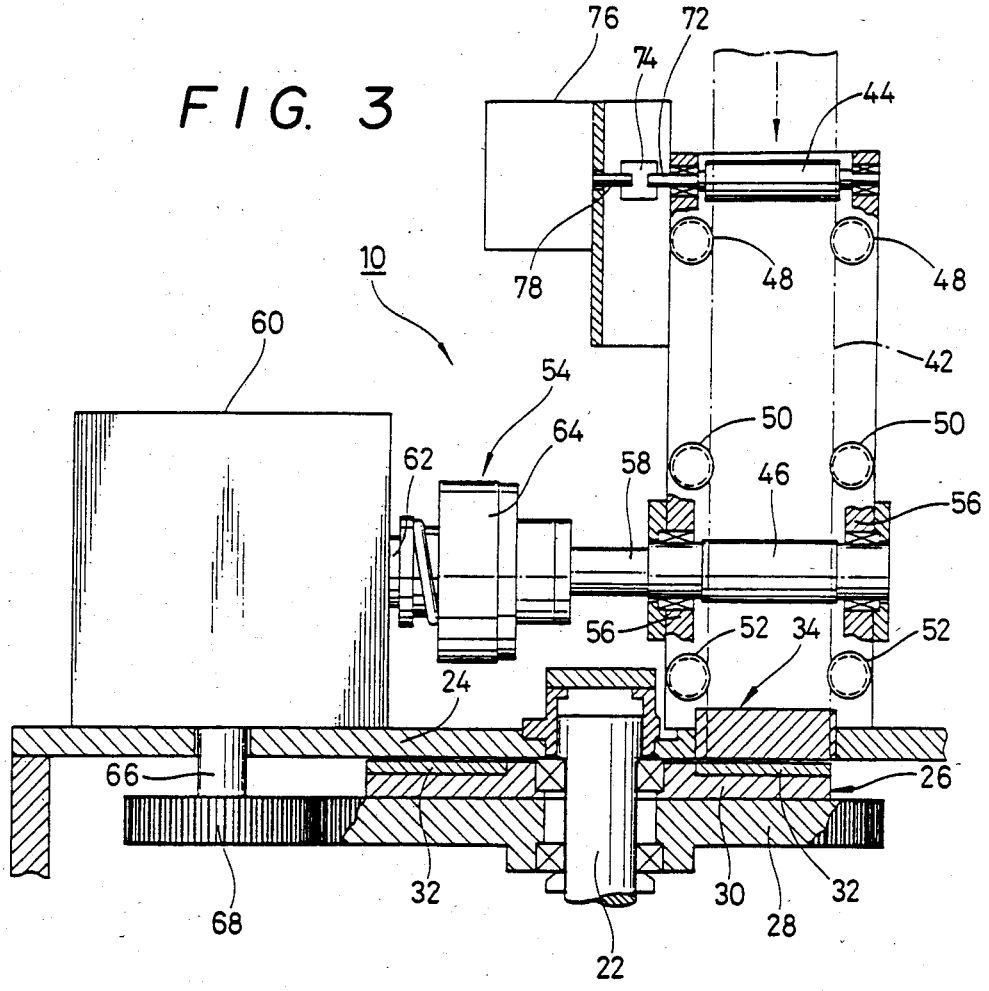
FIG. 3 is a partial sectional view showing one embodiment of a pre-shaped article forming means for shaping a metallic pull ring which forms the important part of the apparatus of this invention.

In FIG. 3, the pre-shaped article forming means 10 includes a stationary support shaft 22. A horizontal support plate 24 is fixed to the upper end portion of the support shaft 22. Furthermore, a movable shearing tool 26 located beneath the support plate 24 is mounted on the support shaft 22. The movable shearing member 26 has a large gear 28 rotatably mounted on the support shaft 22 and a circular rotating support 30. The large gear 28 and the rotating support 30 are fixed to each other so that they rotate as a unit. The peripheral portion of the upper surface of the rotating support 30 is located somewhat lower than the central part of its upper surface, and a plurality of movable shearing blades 32 are fixed to the upper peripheral portion of the support 30 at equiangular intervals in the circumferential direction (refer to FIGS. 3 and 4).

An opening (not shown) is formed at a predetermined angular position of the support plate 24 which corresponds to the pre-shaped article holding zone A in FIG. 2. A stationary shearing tool 34 acting in cooperation with the movable shearing tool 26 is fixed at this opening.

Figure 5:
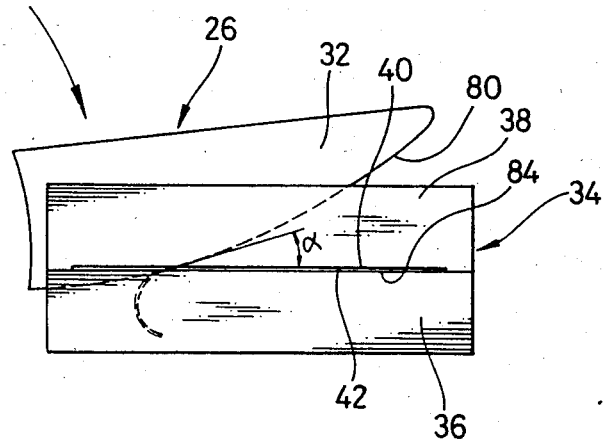
FIGS. 5 to 7 are partial perspective view showing shearing and forming of a pre-shaped article by a movable shearing blade and a stationary shearing blade of the apparatus of this invention shown in FIG. 3.
Figure 6:
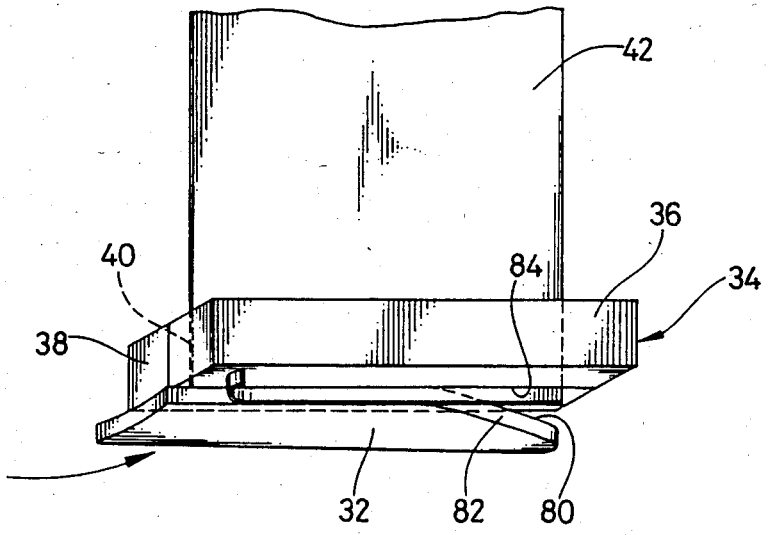

The movable shearing tool 26 and the stationary shearing tool 34 are constructed and arranged as shown in FIGS. 5 and 6. The stationary shearing tool 34 has a rectangular stationary shearing blade 36 and a rectangular stationary guiding and restraining member 38. The shearing blade 32 and the guiding and restraining member 38 are linked to each other so that the lower surfaces of the two defines a substantially horizontal common place. A guide groove extending vertically formed on that surface of the guiding and restraining member 38 which is to abut against the shearing blade 36, and by this guide groove, a vertically extending guide slot 40 is defined between the shearing blade 36 and the guiding and restraining member 38. The guide slot 40 has a cross sectional shape corresponding to the cross sectional shape of a thin metal strip 42 to be sheared by the cooperative action of the movable shearing tool 26 and the stationary shearing tool 34, and the thin metal strip 42 is fed from top to bottom through the guide slot 40.

As shown in FIG. 3, the thin metal strip 42 is passed between a guide roll pair 44 and feed roll pair 46 and then inserted in the guide slot 40 defined in the stationary shearing tool 34. Between the guide roll pair 44 and the feed roll pair 46 are disposed a guide grooved pulley pair 48 and a guide grooved pulley pair 50 which guide both side edges of the thin metal strip 40. Likewise, a guide grooved pulley pair 52 for guiding both side edges of the thin metal strip 42 is disposed between the feed roll pair 46 and the stationary shearing tool 34.

The feed roller pair 46 constitutes an output end of metal strip feeding means 54 for feeding the thin metal strip 42 intermittently by a predetermined distance. As shown in FIG. 3, one feed roll 46 is fixed to a driven shaft 58 mounted rotatably on a frame 56 which is fixed to the support plate 24. The driven shaft 58 is connected through a coupling 64 to an output shaft 62 of an intermittent motion mechanism 60 of a known structure disposed on the support plate 24. An input shaft 66 of the intermittent motion mechanism 60 extends downwardly through the support plate 24, and to its lower end is fixed a gear 68 in mesh with the large gear 28 of the movable shearing tool 26. The large gear 28 of the movable shearing tool 26 is drivingly connected to a drive power source through a suitable power transmission mechanism (now shown), and the movable shearing tool 26 is rotated continuously at a predetermined speed in the direction of the arrow of FIG. 2. As a result, the input shaft 66 of the intermittent motion mechanism 60 is continuously rotated through the gears 28 and 68, and the output shaft 62 of the intermittent motion mechanism 60 and the driven shaft 58 connected to it are rotated intermittently by a predetermined amount. Thus, the feed roller pair 46 is intermittently rotated by a predetermined amount in a direction to feed the thin metal strip 42 from top to bottom in a synchronized relationship with the rotation of the movale shearing tool 26. The feeding distance of the thin metal strip 42 for one feeding is made to agree with the widthwise size of the rectangular blank forming the pre-shaped article 70 shown in FIG. 8.

Figure 7:
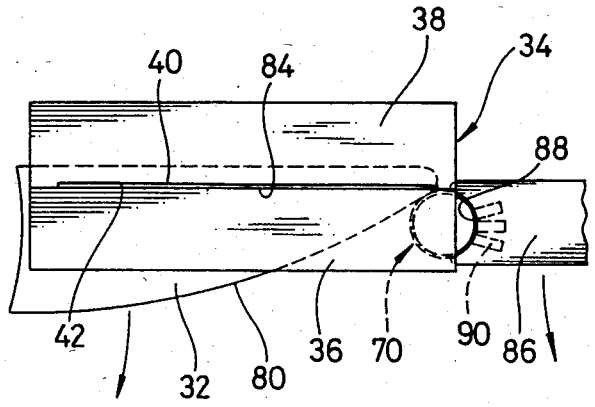

In the embodiment shown in FIG. 3, a detecting input shaft 78 of a rotating encoder 76 known per se is connected through a coupling 74 to a rotating shaft 72 to which one guide roller 44 is fixed for checking unacceptable articles. The rotating encoder 76 detects the amount of rotation of the guide roller pair 44, and therefore the feeding distance of the thin metal strip 42, and produces a warning signal in the event that the feeding distance of the thin metal strip 42 for one feeding should fall outside the predetermined range. Should such a warning signal be produced by the rotating encoder 76, a finished closure formed with the pre-shaped article is likely to be of poor quality. Accordingly, the finished closure being of poor quality can be disposed of in response to the warning signal. With reference to FIGS. 5 to 7, the forming of pre-shaped article 70 by the cooperative action of the movable shearing tool 26 and the stationary shearing tool 34 will be described in detail.

Figure 4:
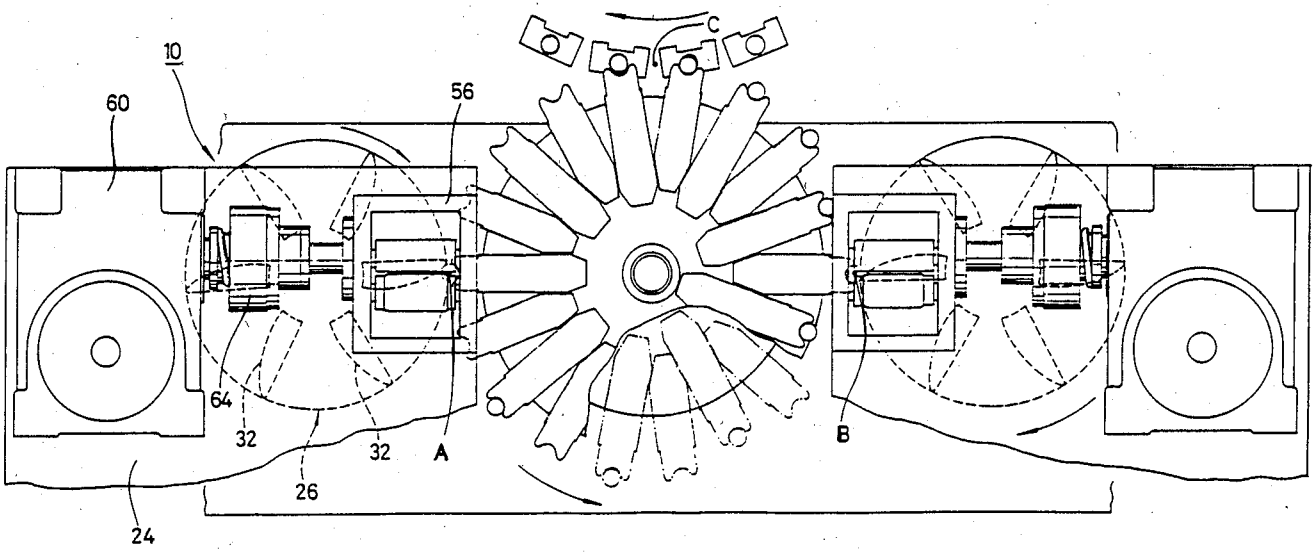
FIG. 4 is a plane view showing connection between a pre-shaped article forming means and a pre-shaped article feed means adjoining thereto shown in FIG. 3.

In the shown embodiment, as already stated, the movable shearing tool 26 has the rotating support 30 (FIG. 4) to be rotated continuously in the direction of the arrow of FIG. 4 and the shearing blades 32 fixed to the peripheral part of the upper surface of the rotating support 30 at circumferentially spaced equiangular intervals. As the rotating support 30 is rotated, the shearing blades 32 succesively cooperate with the single stationary shearing blade 36 of the stationary shearing tool 34 to shear the thin metal strip 42. The thin metal strip 42 is fed downwardly after a given movable shearing blade 32 has sheared the thin metal strip 42 in cooperation with the stationary shearing blade 36 and before the next movable shearing blade 32 begins to cooperate with the stationary blade 36, and the leading portion of the thin metal strip 42 is fed downwardly a predetermined distance beyond the lower surface of the staionary shearing 36.

Each of the movable shearing blades 32 has a raised blade edge 80 defined by its upper end edge and a raised pressing surface 82 (see FIG. 6) extending from the edge 80, at its front part as viewed in the rotating direction. The blade edge 80 cooperates with a blade edge 84 of the stationary shearing blade 36 which is defined by the lower end edge of that surface of the blade 36 which is to be brought into abutment against the stationary guiding and restraining member 38, and shears the leading portion of the thin metal strip 42. Conveniently, the shape of the blade edge 80 of each of the movable shearing blades 32 is determined so as to meet not only the requirement that the blade edge 80 should shear the thin metal strip 42 by gradually acting on it from its radially inward end toward its radially outward end, but also the requirement that in order to exert a uniform shearing action over the entire width of the thin metal strip 42 during the shearing, the shearing angle formed between the thin metal strip 42 and the tangent line of the edge 80 at a site at which it actually exerts a shearing action on the thin metal strip 42 should not substantially vary over the entire length of the blade edge 80. Conveniently, the angle $\alpha$ shown in FIG. 5 is 20 to 35 degrees, particularly 25 to 30 degrees.

Figure 8:
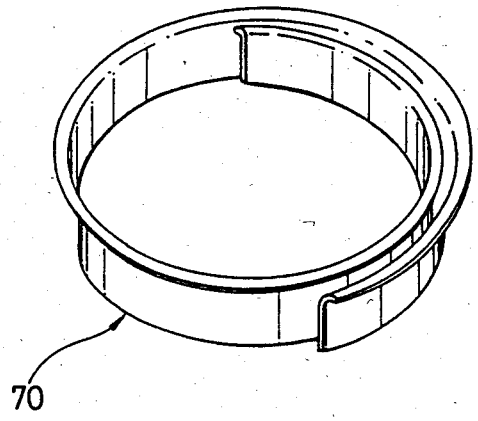
FIG. 8 is a perspective view of a pre-shaped article formed by the apparatus of this invention.

When the leading end portion of the thin metal strip 42 is to be gradually sheared from its one side edge toward its other side edge by the cooperative action of the blade edge 80 of the movable shearing blade 32 and the blade edge 84 of the stationary shearing blade 36 in the above-described manner, the shearing force exerted on the leading end portion of the metal strip 42 from the blade edge 80 tends to bend the forward end portion of the metal strip 42 from its one side edge toward its other side edge as shearing proceeds. The pressing surface 82 of each of the movable shearing blades 32 gradually presses one surface of the leading end portion of the thin metal strip 42 from its one side edge (the left side edge in FIG. 5) toward its other side edge (the right side edge in FIG. 5) as shearing proceeds; and consequently the pressing surface 82 increases the aforesaid tendency of the leading end portion of the thin metal strip 68 to be bent from its one side edge to the other side edge. Conveniently, the pressing surface 82 is inclined by an angle of 0.5 to 215 degrees forwardly in the rotating direction in a direction away from the blade edge 80, as described in the specification and drawings of the above Patent Application No. 13855/1983. Thus, when the forward end portion of the metal strip 42 has been completely sheared, it becomes a nearly annular pre-shaped article 70 (see FIGS. 7 and 8) in which the rectangular blank is bent in its longitudinal direction and its both end portions are caused to overlap each other. As shown in FIG. 8, the upper edge portion of the pre-shaped article 70 is warped slightly outwardly by the so-called shearing warpage during the shearing operation. This warpage acts advantageously in the shaping of the pre-shaped article 70 into the pull ring in the pull ring shaping and connecting means. As stated hereinabove, the pre-shaped article 70 formed from the leading end portion of the thin metal strip 42 is located outermost as viewed in the radial direction of the position of shearing by the cooperative action of the stationary shearing blade 36 and the movable shearing blade 32 (FIG. 7). This outermost position corresponds to the pre-shaped article holding zone A shown in FIG. 2. The pre-shaped article feed means 12 holds the pre-shaped article 70 existing in the pre-shaped article holding zone A. As shown in FIG. 7, the pre-shaped article feed means 12 has formed at its end portion a curved surface 88 whose diameter is somewhat larger than that of the pre-shaped article 70, and magnets 90 are fixed to the surface 88. The pre-shaped article feed means 12 can hold the pre-shaped article 70 by the action of a magnetic force.

In the shown embodiment, a second pre-shaped article forming means 10 which is constructed in entirely the same way as above is provided symmetrically with the aforesaid pre-shaped article forming means (see FIGS. 2 and 4). This doubles the amount of pre-shaped article 70 fed to both of the means and increases forming capacity of container closure in the pull-ring shaping and connecting means.

With reference to FIGS. 9 to 12, the pre-shaped article feeding means which forms an important part of the apparatus of this invention will now be described in detail.

Figure 9:
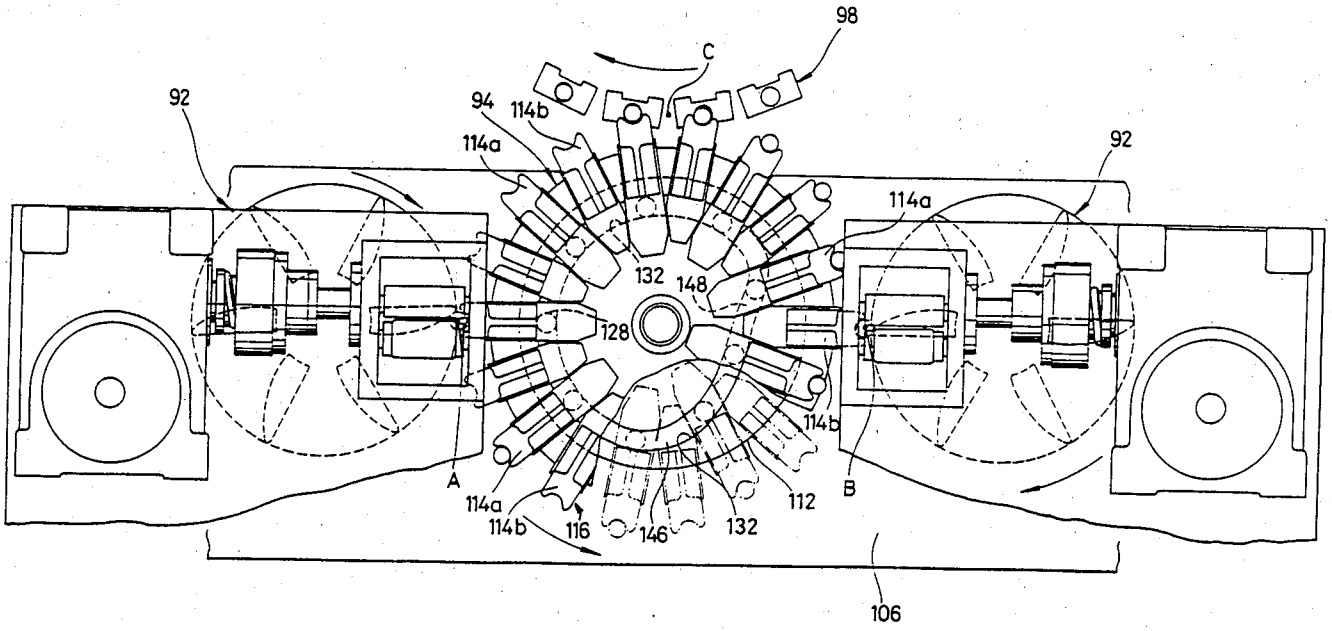
FIG. 9 is a plane view showing one embodiment of a pre-shaped article feed means for forming a metallic pull ring which forms an important part of the apparatus of this invention.
Figure 10:
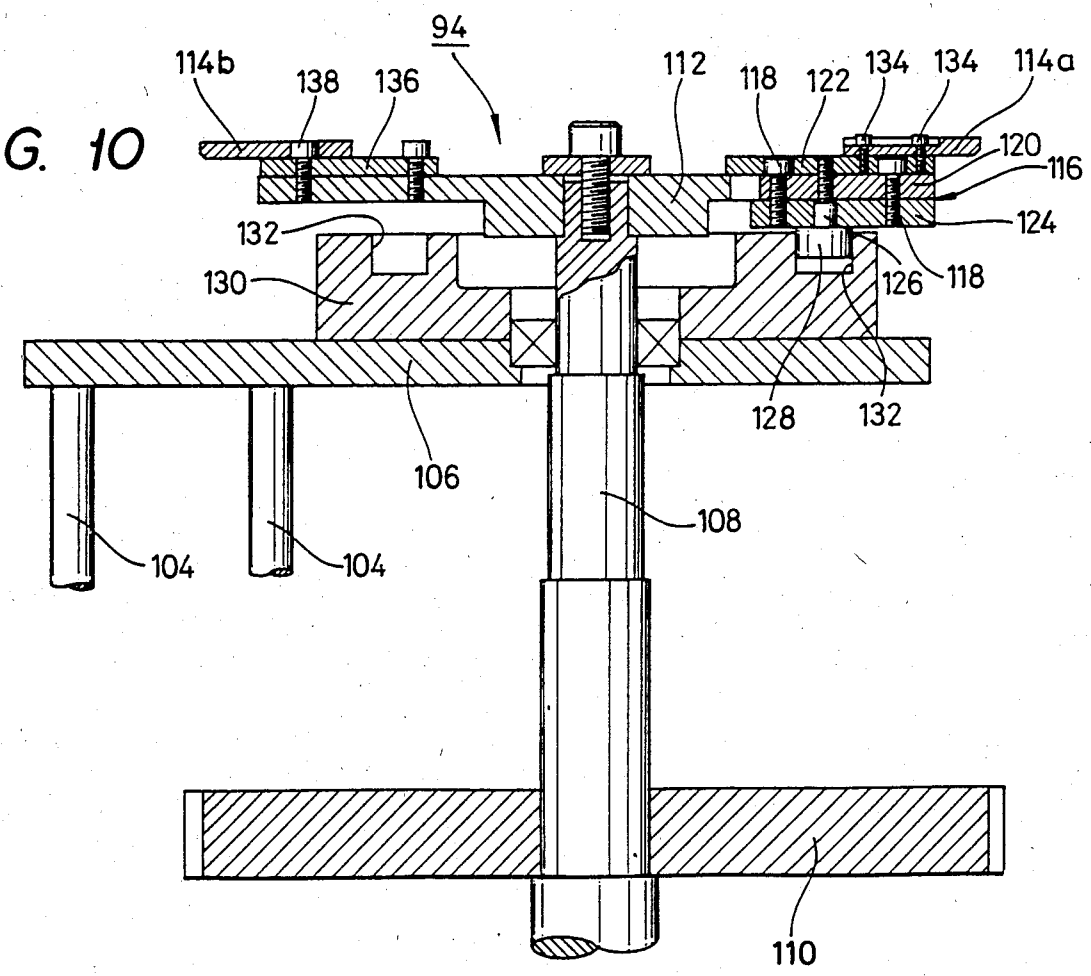
FIG. 10 is a partial sectional side view of a pre-shaped article feed means shown in FIG. 9.

In FIG. 9, the pre-shaped article feed means 94 acts to hold an annular pre-shaped article one by one continuously formed by the pre-shaped article forming means 92 and to feed it in succession to the next process of the pull ring shaping and connecting means 98. The pre-shaped article feed means 94 of this embodiment includes a stationary support plate 106 supported by at least one support leg 104 and a rotating shaft 108 extending vertically through the stationary support plate 106 as shown in FIG. 10. A large input gear 110 suitably drivingly connected to a drive power source is fixed to the lower part of the rotating shaft 108. A disc 112 is fixed to the upper end portion of the rotating shaft 108. On the circumferential edge portion of the upper surface of the disc 112, there are mounted a plurality of holding member 114*a* and 114*b* at equiangular intervals in the circumferetial direction, as illustrated in FIG. 9. Out of the plurality of these holding members 114*a* and 114*b*, a half of holding members, 114*a* which are alternately arranged between the holding members 114*b* and are mounted on the disc 112 so as to be slidable in the radial direction. The other half of holding members, 114*b* are fixed to the disc 112. That is, radially extending guide grooves are formed respectively at the angular positions at which a half of holding members 114*a* are located, and to each of these guide grooves a slider 116 is mounted radially slidably. With reference to FIG. 10 taken in conjunction with FIG. 11, each of the sliders 116 is composed of a sliding member 120, an upper guide plate 122 and a lower guide plate 124 which are connected to each other by means of at least one setscrew 118. The upper guide plate 122 and the lower guide plate 124 which hold the sliding member 120 therebetween have a larger width and length than the width and length of the guide groove. It is constructed such that the lower surface of the upper guide plate 122 makes contact with the upper surface of the disc 112, and the uppper surface of the lower guide plate 124 makes contact with the lower surface of the disc 112. A shaft 126 extending downwardly beyond the lower guide plate 124 is fixed to each of the sliders 116, and a lower roller 128 is rotatably mounted on the lower end of the shaft 126. On the other hand, an annular cam block 130 is fixed to the stationary support plate 106, and on the upper surface of the annular cam block 130 is formed a cam groove 132 in which the follower roller 128 is to be received. Accordingly, when the disc 112 is rotated by the rotation of the rotating shaft 108, the slider 116 is also rotated. During this rotation, the slider 116 is caused to slide radially according to the configuration of the cam groove 132. According to this embodiment, half of the holding members 114*a* are fixed to the upper guide plate 122 by a setscrew 134, and are constructed to be rotated as a unit with the sliders 116 and caused to slide radially (refer to FIG. 10). In contrast, the remaining one half of the holding members 114*b* are fixed to the disc 112 by a setscrew 138 through a linking member 136 (refer to FIG. 10). In this case, the holding members 114*b* are rotated with the disc 112, but are kept from sliding radially of the disc 112.

Figures 11, 12:
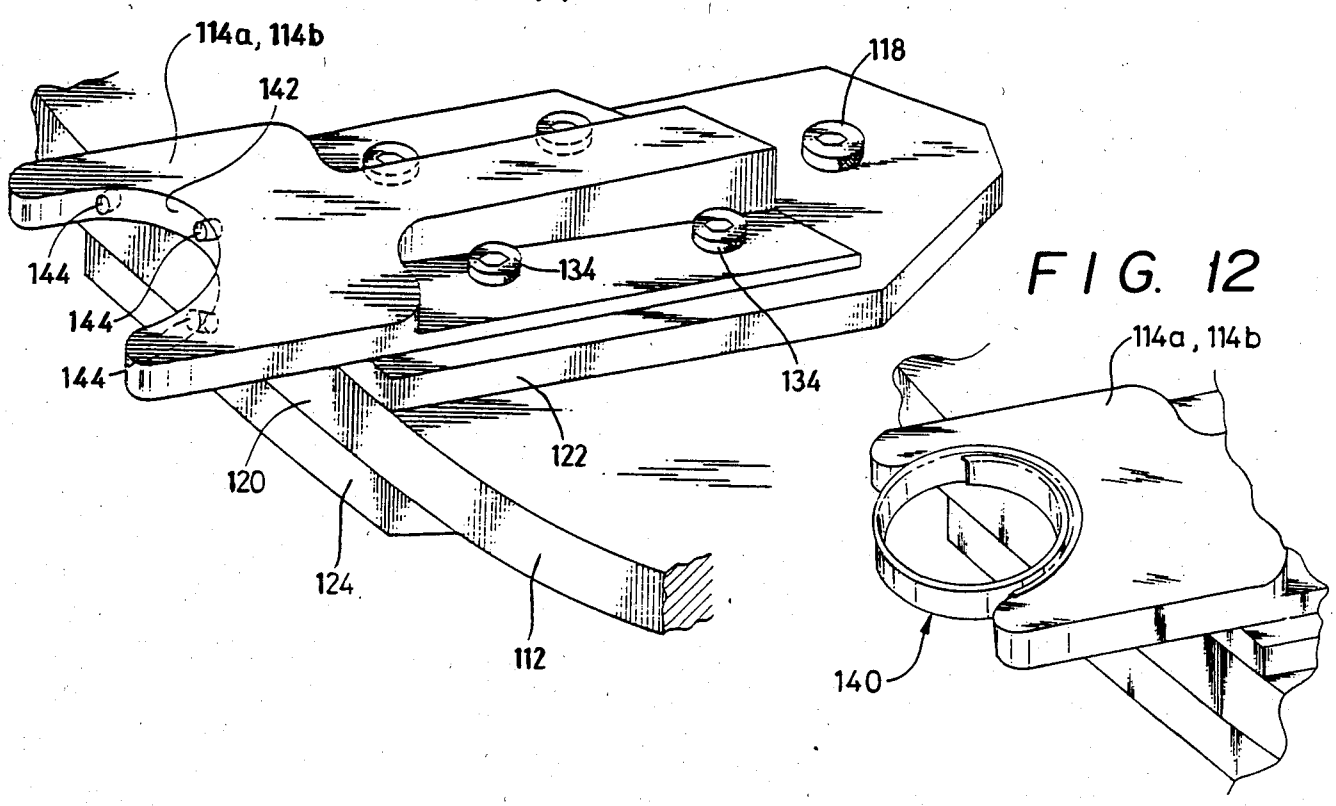
FIG. 11 is an enlarged perspective view showing fixed state of holding members shown in FIG. 9.
FIG. 12 is a perspective view of the pre-shaped article to be handled in the apparatus of this invention.

Description is given in detail regarding the construction of the holding members 114*a* and 114*b*. As is shown in FIG. 11, there is formed at the end portion projecting beyond the periphery of the disc 112, for example, formed as shown in FIG. 12, a nearly semicircular cut 142 for receiving nearly one half of the pre-shaped article 140 to be held. Magnets 144 are fixed to the end surface of the disc 112 which defines the cut 142. By the magnetic action produced by the magnets 144, the holding members 114*a* and 114*b* so constructed magnetically attract, and hold the preshaped article 140 made of a magnetic metallic material to and in the cut 142. If the pre-shaped article 140 is made of a non-magnetic metallic material, it is suitable that the magnets 144 replaced by another holding means such as a vacuum attracting means or a mechanical holding means provided on the holding members 114*a* and 114*b* to hold the pre-shaped article.

The operation of the pre-shaped feed means 94 having the structure described above will be described below with reference to FIGS. 2, 9 and 10. The rotating shaft 108 and the disc 112 are continuously drivingly rotated by the driving power transmitted from a driving power source not shown to the input gear 110 fixed to the lower part of the rotating shaft 108. During this rotation of the disc 112, one half of the holding members 114*a* which are alternately arranged between the holding members 114*b* out of the holding members 114*a* and 114*b* hold the pre-shaped article 140 (refer to FIG. 12) formed by the pre-shaped article forming means 92 in the pre-shaped article holding zone A, and convey it to the pre-shaped article receiving zone C. On the other hand, the remaining one half of the holding members 114*b* hold the pre-shaped article 140 formed by the separately provided pre-shaped article forming means 92 in the pre-shaped article holding zone B, and convey it to the pre-shaped artcle receiving zone C.

The pre-shaped article 140 conveyed to the pre-shaped article receiving zone C is then received by the pull ring shaping and connecting means 98.

The one half of the holding members 114*b* hold the pre-shaped article 140 when passing the pre-shaped article holding zone B, but do not hold the pre-shaped article when passing the pre-shaped article holding zone A to deliver the pre-shaped article 140 to the pull ring shaping and connecting means 98 in the pre-shaped article receiving zone C. However, the other half of the holding members 114*a* hold the pre-shaped article 140 when passing the pre-shaped article holding zone A, and acts to deliver the pre-shaped article 140 to the pull ring shaping and connecting means 98 in the pre-shaped article receiving zone C passing the other pre-shaped article holding zone B in the state as it is. Therefore, in this embodiment, it is constructed such that the holding member 114*a* and the slider 116 connected to it are gradually retracted radially inwardly from the normal position by the cam groove 132 when they are in a zone 146, and they are gradually returned radially outwardly to the normal position by the cam groove 132 in a zone 148. By this, when the one half of the holding members 114*a* passes the pre-shaped article holding zone B in the state of holding the pre-shaped article 140, it is possible to prevent the interference to the pre-shaped article being formed in the pre-shaped article forming means 92.

In the pre-shaped aricle feed means 94 of this embodiment, there is an advantage that the pre-shaped article 140 to be formed by the pre-shaped article forming means 92 is formed annularly with its both ends overlapping each other, but both ends which overlap with each other are positioned on the side of the pre-shaped article forming means 92 and that in the cut 142 of the holding members 114*a* and 114*b*, outside surface of the portions other than both-end portions overlapped with each other of the pre-shaped article 140 are always held at the definite position.

Figure 13:
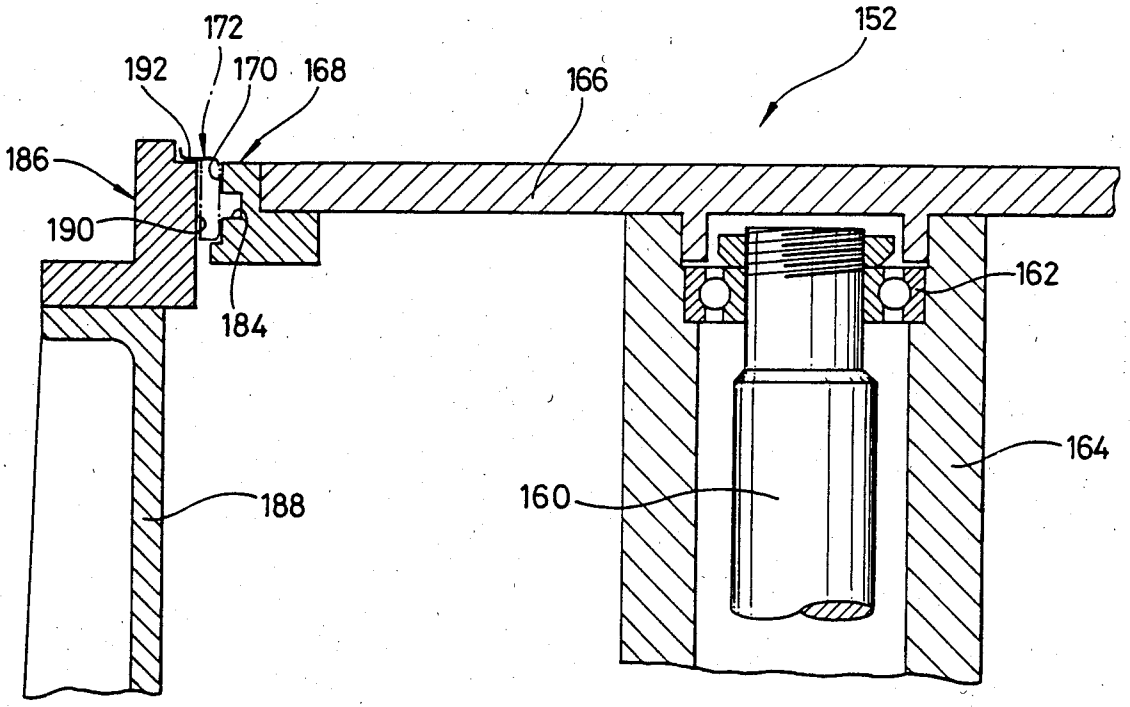
FIG. 13 is a partial sectional side view showing one embodiment of a closure feed means for feeding a closure which is connected to a metallic pull ring formed from a pre-shaped article, which forms an important part of the apparatus of this invention.
Figure 14:
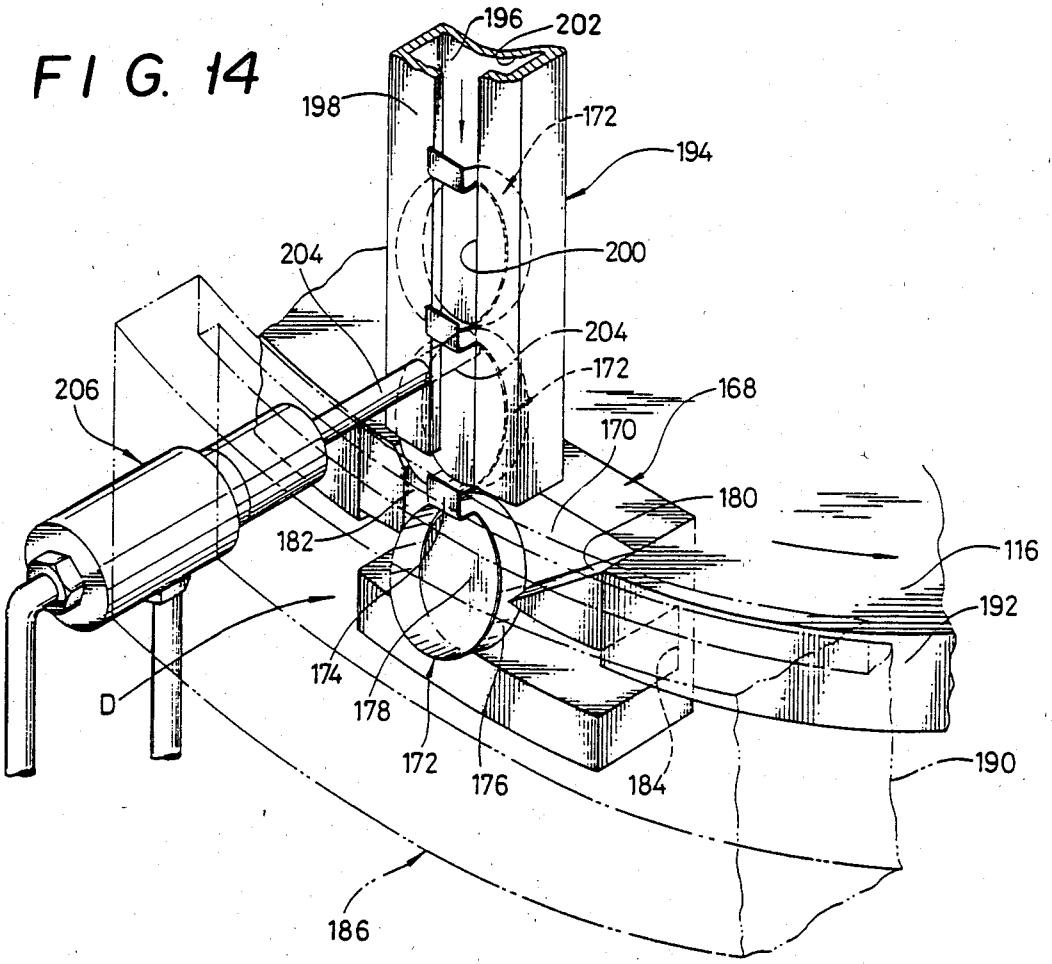
FIG. 14 is an enlarged perspective view of an important part of the closure feed means shown in FIG. 13.

With reference to FIGS. 13 and 14, the closure feed means which forms an important part of the apparatus of this invention will now be described in detail. The closure feed means 152 in the apparatus of this invention comprises a substantially vertically extending stationary support shaft 160, and a hollow cylindrical member 164 is rotatably mounted about the support shaft 160 through a bearing member 162. A rotating conveying table 166 is fixed to the upper end of the hollow cylindrical member 164 and is connected to a suitable driving power source to continuously drivingly rotate the rotating conveying table 166 in a predetermined direction. A plurality of circumferentially equally spaced closure receiving blocks 168 are fixed to the periphery of the rotating conveying table 166. The peripheral surface of each of these blocks 168 has formed therein a closure receiving pocket 170 opened both radially outwardly and vertically upwardly. The pocket 170 has a radial depth which is about one-half of the height of the skirt wall 176 of the closure 172. One side surface 180 of the upper half of the pocket 170 (i.e., that side surface which is on the downstream side as viewed in the rotating direction of the rotating conveying table 166) is inclined downwardly toward the upstream side as viewed in the rotating direction of the rotating conveying table 166 (refer to FIG. 14).

The other side surface 182 of the upper half of the pocket 170 (i.e., that side surface which is on the upstream side as viewed in the rotating direction of the conveying table 166) is such that its upper end is inclined downwardly as viewed in the rotating direction of the rotating conveying table 166, but a greater portion of it following the inclined upper end portion extends substantially vertically. The lower end portion of the pocket 170 is arcuate corresponding to a part of the contour of the skirt wall 176 of the closure 172. A groove 184 extending over the entire circumference of the closure receiving block 168 is formed in a nearly intermediate part of the block 168 in the vertical direction of the pocket 170. The radial depth of the groove 184 is made much larger than that of the pocket 170. The radial inside portion of the groove receives one end of an arcuate stationary guide rail disposed in the pull ring shaping and connecting means 16 at the closure receiving zone E to be mentioned hereinafter.

The closure feed means 152 in this embodiment further includes a stationary guide rail 186 extending along the peripheral surface of the conveying table 166. The stationary guide rail 186 is supported by a support leg 188, and extends to the closure receiving zone E from a point somewhat upstream of the closure holding zone D as viewed in the rotating direction of the conveying table 166 (see FIG. 2). The inner surface 190 of the stationary guide rail 186 is spaced from the peripheral surface of the block 168 by a predetermined distance (for example, corresponding to about one-half of the height of the skirt wall 176 of the closure 172). The inside portion 192 of the upper surface of the stationary guide rail 186 excepting the downstream end portion, is a flat surface having substantially the same height as the upper surface of the block 168.

As shown in FIG. 14, a closure feed chute 194 at least the lower end portion (discharge end) of which extends substantially vertically to the container closure feed means 152 is disposed in the closure holding zone D. The chute 194 includes a feed passage 196 having a width corresponding to the outside diameter of the closure 172. An open groove 200 having a width corresponding to the width of the tear-off tab piece 174 of the closure 172 is formed in the central portion, in the widthwise direction, of a front wall 198 defining the front surface of the feed passage 196. The lower end of the chute 194 is located in proximity to the upper surface of the conveying table 166, and comes into registration with the pocket 170 formed in the block 168 when the rotation of the conveying table 166 moves the block 168 to below the chute 194.

In the closure feed means 152 constructed as above, the closure 172 is delivered to the chute 194 from a suitable supply source (not shown), and fed through the chute 194. The closure 172 is delivered to the chute 194, and fed through the chute, in such a state that as shown in FIG. 14 the outside surface of its top panel wall 178 faces a rear wall 202 of the chute 194 and its tear-off tab piece 174 projects forward through the open groove 200 formed in the front wall 198 and is located rearwardly as viewed in the feeding direction. Every time the block 168 descends and is situated below the chute 194 by the rotation of the conveying table 166, one closure 172 is discharged from the lower end of the chute 194 and received in the pocket 170 of the block 168. In this case, the closure 172 is received in the pocket 170 of the block 168 in such a state that the outside surface of its top panel wall 178 faces radially inwardly and its tear-off tab piece 174 is located uppermost in the vertical direction (refer to FIG. 14). When the closure 172 has been received in the pocket 170 of the block 168 as above the base portion of the tear-off piece 174 of the closure 172 contacts the upper surface 192 of the stationary guide rail 186 and is held there, whereby the closure 172 is prevented from revolving about its axis within the pocket 170. Furthermore, the lower edge of the skirt wall 176 projecting radially outwardly from the pocket 170 contacts the inner surface 190 of the stationary guide rail 186 whereby the closure 172 is prevented from coming out of the pocket 170 radially outwardly by the centrifugal force acting on the closure 172 owing to the rotation of the conveying table 166. Accordingly, the closure 172 received in the pocket 170 is conveyed in the predetermined direction by the rotation of the conveying table 166 while it is maintained in the state illustrated in FIG. 14. When the closure 172 received in the pocket 170 is conveyed to the closure receiving zone E (FIG. 2), it is delivered from the pocket 170 to the pull ring shaping and connecting means 16.

Further in the container closure feed means 152 in this embodiment, there is provided a transfer-checking pin 204 which is selectively actuated and checks transferring of the closure 172 from the chute 194 to the pocket 170 of the block 168. The pin 204 is movably mounted between the non-operating position shown by a solid line to the operating position shown by a two-dotted chain line in FIG. 14. In the pin 204, an actuating means 206 such as a hydraulic cylinder mechanism is provided, and the pin 204 relatively fixes positioning at either the non-operating position or the operating position by the actuating means 206. Although in the non-operating position, the pin 204 never interferes transferring of the container closure 172 from the chute 194 to the pocket 170 of the block 168, in the operating position the free end portion of the pin 204 projects into the chute 194 through the open groove 200, penetrates into the skirt wall 176 of the container closure 172 positioned at the lower end of the chute 194 and checks the downward movement of the closure 172. Also, the pin 204 is positioned in the operating position when the operation of the apparatus is stopped while when the operation of the apparatus is started the pin 204 is positioned at the non-operating position at a predetermined timing, and it is again positioned in the operating position immediately before the operation of the apparatus is stopped at a predetermined timing.

Positioning of the pin 204 from the operating position to the non-operating position and from the non-operating position to the operating position is performed at the time when the pocket 170 of the block 168 disposed on the periphery of the rotating conveying table 166 is not below the chute 194, therefore, at the time when the portion between the pocket 170 is below the chute 194 and the closure 172 which is at the lower end of the chute 194 is not even partially in the pocket 170. Such a timing of positioning the pin 204 can be set by sensing the rotation of the rotating conveying table 166 using, for example, a suitable rotation encoder, etc.

Further with reference to FIGS. 15 to 24, the pull ring shaping and connecting means which forms an important part of the apparatus of this invention will now be described in detail.

Figure 15:
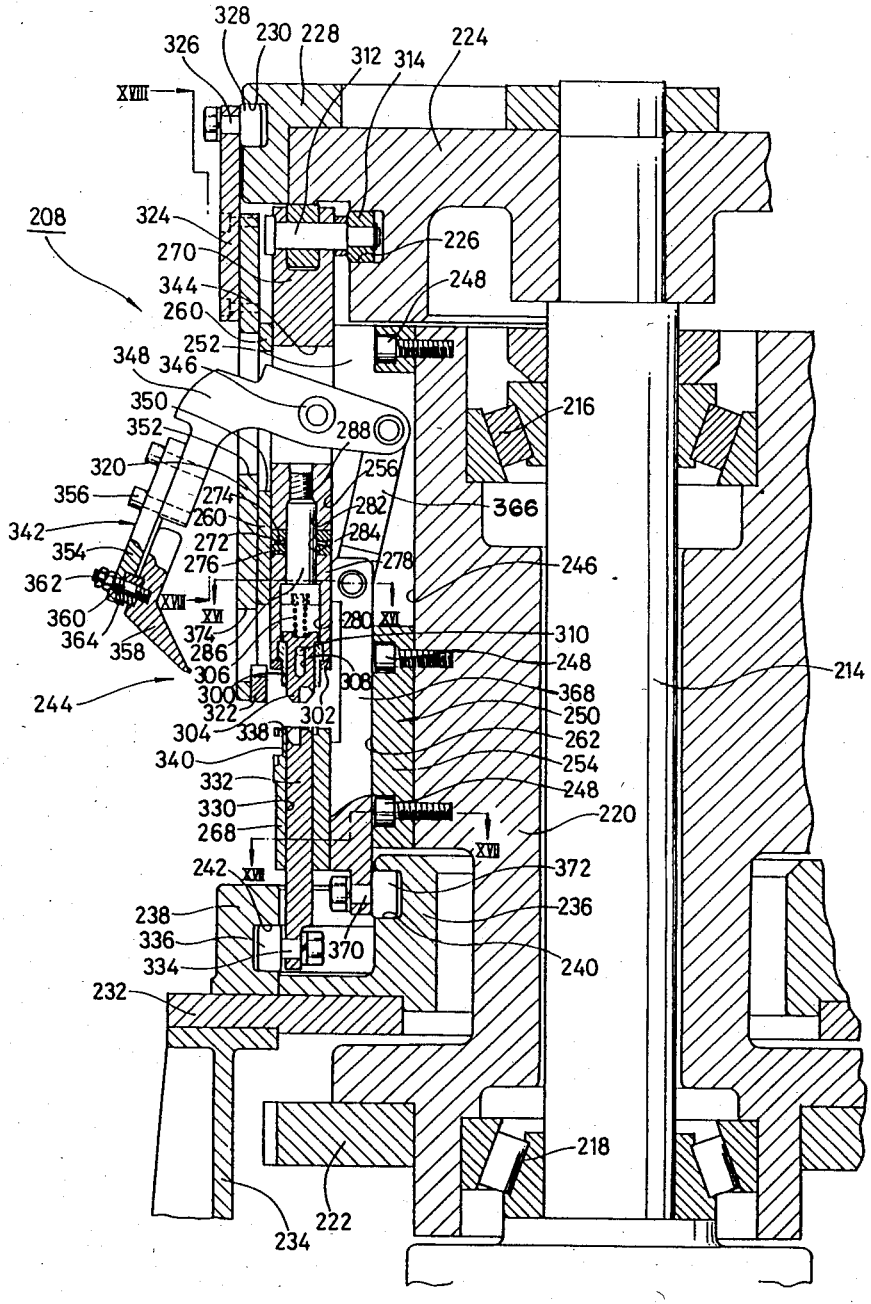
FIG. 15 is a sectional side view of an important part showing one embodiment of the shaping of the metallic pull ring and connecting the closure thereto, which forms an important part of this invention.

In FIG. 15, the pull ring shaping and connecting means 208 includes a substantially vertically extending stationary support shaft 214. A rotating support 220 is mounted rotatably about the support shaft 214 through bearing members 216 and 218. To the lower end portion of the rotating support 220 is fixed a large input gear 222 drivingly connected to a driving power source (not shown), and the support 220 is adapted to be continuously rotated in the predetermined direction. A first annular cam block 224 is fixed to the upper end portion of the support shaft 214, and an annular cam groove 226 is formed on the peripheral surface of a cylindrical downwardly extending portion of the first annular cam block 224. A second annular cam block 228 is fixed to the periphery of the upper end portion of the first annular cam block 224, and an annular cam groove 230 is formed on the peripheral surface of the second annular cam block 228. The pull ring shaping and connecting means 208 further comprises an annular stationary support plate 232 located around, and spaced from, the lower end portion of the rotating support 220. The stationary support plate 232 is supported by a support leg 234, and a third annular cam block 236 and a fourth annular cam block 238 are fixed to the upper surface of the stationary support plate 232. An annular cam groove 240 is formed on the peripheral surface of the third annular cam block 236, and an annular cam groove 242, on the inner circumferential surface of the fourth annular cam block 238.

Figure 16:
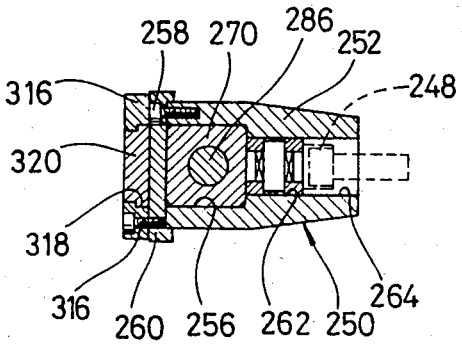
FIG. 16 is a sectional view of an essential part of XVI—XVI line of means shown in FIG. 15.
Figure 17:
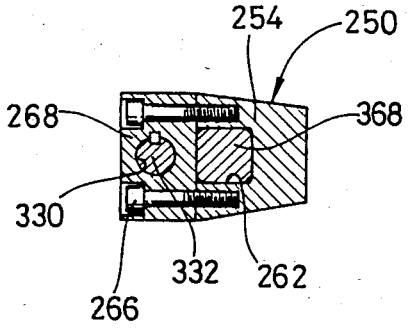
FIG. 17 is a sectional view of an essential part of XVII—XVII line shown in FIG. 15.

A plurality of pull ring shaping and connecting units 244 are arranged on the rotating support 220 at equal intervals in the circumferential direction. The upper half portion of the rotating support 220 has a regular tetracosagonol outershape, and a pull ring shaping and connecting unit 244 is disposed at each of outside surfaces 246. Each pull ring shaping and connecting unit 244 has a supporting member 250 fixed to the outside surface 246 of the rotating support 220 by means of a setscrew 248. As shown in FIGS. 16 and 17, the radial size of the upper half portion 252 of the supporting member 250 is larger than that of its lower half portion 254, and the upper half portion 252 projects beyond the radial outside surface of the lower half portion 254. As shown in FIG. 16, the radial outside portion of the upper half portion 252, which projects beyond the radial outside surface of the lower half portion 254, has formed therein a groove 256, square in section, extending vertically therethrough. The groove 256 is radially outwardly opened in the upper half portion 252 of the supporting member 250. An outside member 260 is fixed to the radial outside surface of the upper half portion 252 of the supporting member 250 by means of a setscrew 258, and this outside member 260 covers the radial outside surface of the groove 256. Furthermore, the supporting member 250 has formed therein a groove 262 extending vertically through the radial inside portion of the upper half portion 252 and the lower half portion 254. The groove 262 has a square section slightly smaller than the square section of the groove 256. In the upper half portion 252, the groove 262 directly follows the groove 256 in the radial direction, and in the lower half portion 254 is opened radially outwardly. Furthermore, in the upper half portion 252, there is formed a groove 264 which has the same width as the groove 262 except its upper end portion and extends from the groove 262 to the radially inward end of the supporting member 250 in the upper half portion 252, the supporting member 250 excepting its upper end portion, is continuously opened from its radially inside end to its radially outside end by the grooves 264, 262 and 256. As can be seen from FIGS. 15 and 17, at the lower end portion of the lower half portion 254 of the supporting member 250, an outside member 268 is fixed to the radially outside surface of the lower half portion 254 by means of a setscrew 266, and this outside member 268 covers the radially outside surface of the groove 262.

In FIG. 15, a square pillar 270 having a square cross section corresponding to the cross sectional shape of the groove 256 is mounted vetically slidably in the groove 256 formed in the upper half portion 252 of the supporting member 250. To the lower end of the square pillar 270 is fixed a square pillar 278 through two plate members 274 and 276 holding a belleville spring 272 therebetween. A downwardly opened hole 280 circular in section is formed in the square pillar 278, and there is also formed a hole 282 having a slightly smaller diameter than the hole 280 and extending from the upper end of the hole 280 upwardly through the square pillar 278. A through-hole 284 in alignment with the hole 282 is formed also in the belleville spring 272 and the two plate members 274 and 276 holding it therebetween. A setscrew 286 whose head is to be located at the upper end of the hole 280 formed in the square pillar 278 is inserted through the holes 282 and 284 and threadably received in a screw hole 288 formed at the lower end portion of the square pillar 270. Thus, the two plate members 274 and 276 holding the belleville spring 272 therebetween and the square pillar 278 are fixed to the lower end of the square pillar 270. The two plate members 274 and 276 holding the belleville spring 272 therebetween and the square pillar 278 have the same sectional shape as the square pillar 270, and can slide vertically within the groove 256 together with the square pillar 270. To the lower end of the hole 280 formed in the square pillar 270 is fixed the upper end of an annular upper rolling tool 300. More specifically, the upper end of the upper rolling tool 300 is fixed to the lower end of the hole 280 by bringing the upper end of the upper rolling tool 300 into abutment against a shoulder portion formed on the inner surface of the hole 280 and fixing to the lower end of the square pillar 278 a retaining member 302 which abuts against a shoulder portion formed on the peripheral surface of the upper rolling tool 300. Within the upper rolling tool 300 is mounted vertically slidably an upper mandrel member 304. Between the upper end of the upper mandrel member 304 and the head of the setscrew 286 is interposed a spring member 306 which elastically biases the upper mandrel member 304 vertically downwardly. The vertically downward movement of the upper mandrel member 304 is restricted by the abutment of the lower surface of a flange formed in the upper end of the mandrel member 304 against the upper end surface of the upper rolling tool 300. In the upper mandrel member 304 is formed a vertically extending slot 308, and a horizontal pin 310 extending through the upper rolling tool 300 and fixed at both ends to the pillar 278 is inserted in the slot 308. The horizontal pin 310 permits the upper mandrel member 304 to move vertically upwardly relative to the pillar 278 and the upper rolling tool 300 over a predetermined range against the elastic biasing action of the spring member 306, but prevents the upper rolling tool 300 and the upper mandrel member 304 from rotating relative to the pillar 278 about their vertically extending central axis. On the other hand, a horizontally extending shaft 312 is fixed to the upper end portion of the square pillar 270. To the inwardly projecting end portion of the shaft 312 is rotatably mounted a follower roller 314 received in the cam groove 226 formed in the first annular cam block 224. It will be appreciated therefore that when the rotating support 220 is to be rotated in the predetermined direction, the square pillar 270, and therefore the upper rolling tool 300 and the upper mandrel 304 located at the lower end of the pillar 270, are caused to ascend and descend in the vertical direction in accordance with the track defined by the cam groove 226.

Figure 18:
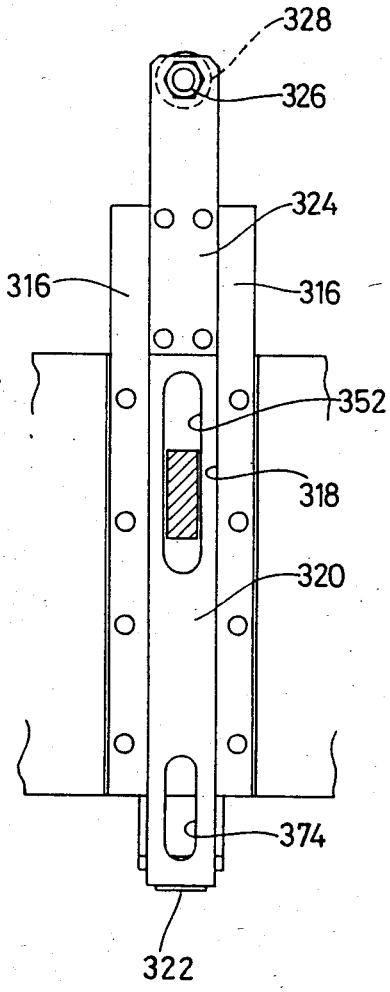
FIG. 18 is a sectional view of an essential part of XVIII—XVIII line shown in FIG. 15.

With reference to FIG. 18 taken in conjunction with FIGS. 15 and 16, a pair of guide members 316 spaced from each other laterally and extending vertically are fixed to the outside surface of the outside member 260 fixed to the radially outside surface of the upper half portion 252 of the supporting member 250. A vertically extending guide groove 318 is defined between the pair of guide members 316. A slender sliding plate 320 is mounted vertically slidably in the guide groove 318. A pressing member 322 made of a flexible material such as a synthetic rubber is bonded to that inside surface of the lower end of the sliding plate 320 which projects downwardly beyond the lower ends of the outside member 260 and the pair of guide members 316. On the other hand, to the outside surface of the upper end portion of the sliding plate 320 is fixed a plate member 324 extending therefrom vertically upwardly, and a horizontally extending shaft 326 is fixed to the upper end portion of the plate member 324. A follower roller 328 received in the annular cam groove 230 formed in the second annular cam block 228 is rotatably mounted on the inside projecting end portion of the shaft 326. It will be readily appreciated therefore that when the rotating support 220 is rotated in the predetermined direction, the sliding plate 320 is caused to ascend and descend vertically in accordance with the track defined by the cam groove 230.

With reference to FIGS. 15 and 17, a hole 330 circular in section, is formed in the outside member 268 fixed to the radially outside surface of the lower half portion 254 of the supporting member 250 so that it extends vertically throught the outside member 268. A lower mandrel member 332 whose main portion except the upper and lower end portions has a circular cross section corresponding to the hole 330 is received in the hole 330 so that it cannot be rotated about its axis but is free to slide vertically. The lower end portion of the lower mandrel member 332 projects downwardly beyond the lower end of the outside member 268, and a shaft 334 extending horizontally is fixed to it. A follower roller 336 received in the cam groove 242 formed in the fouth annular cam block 238 is rotatably mounted on the outside projecting end portion of the shaft 334. It will be appreciated therefore that when the rotating support 220 is rotated in the predetermined direction, the lower mandrel member 332 is caused to ascend and descend vertically in accordance with the track defined by the cam groove 242. The lower mandrel 332 is located in vertical alignment with the upper mandrel member 304 and cooperates with the upper mandrel member 304. An annular lower rolling tool 338 is fixed to the upper surface of the outside member 268. The lower rolling tool 338 located around the hole 330, and therefore around the lower mandrel member 332 is located in vertical alignment with the upper rolling tool 300, and cooperates with the upper rolling tool 300. Furthermore, a closure body receiving pocket 340 for receiving the closure body is formed on the upper end portion of the outside surface of the outside member 268.

In FIG. 15, each pull ring shaping and connecting unit 244 further comprises a hammer means shown generally at 342. An intermediate portion of the square pillar 270 in its vertical direction has formed therein an opening 344 extending therethrough radially, and in the opening 344 is set a pin 346 which is fixed at both ends to the pillar 270 and extends in a direction perpendicular to the sheet surface in FIG. 15. A nearly L-shaped arm 348 of the hammer means 342 is pivotally mounted on the pin 346. The forward end portion of the arm 348 projects outwardly through an opening 350 formed in the outside member 260 and an opening 352 formed in the sliding plate 320 (see FIG. 18). To the forward end of the arm 348 is fixed by means of a setscrew 356 a liking member 354 further projecting therefrom, and a hammer tool 358 is mounted on the linking member 354. The method of mounting the hammer tool 358 on the linking member 354 will be described hereinbelow. A through-hole is formed at the end of the liking member 354, and a linking rod 360 threaded at both ends extends through this through-hole. One end portion of the linking rod 360 is threadably fitted in the hammer tool 358, and a check nut 362 is threadably received about the other end portion of the linking rod 360 which projects beyond the outside surface of the linking member 354. Depressed portions are formed respectively on the facing surfaces of the linking member 354 and the hammer tool 358, and a plurality of belleville springs 364 through which the linking rod 360 extends are received in the space defined by these depressed portions. The belleville springs 364 elastically reduce the shock of an impact which occurs when the forward end of the hammer tool 358 strikes and presses the free end portion of the tear-off tab piece of the closure body in the manner to be described hereinafter. On the other hand, the rear end portion of the arm 348 projects into the grooves 262 and 246 formed in the supporting member 250, and one end of a linking lever 366 is pivotally linked to the rear end portion of the arm 348. The other end of the linking lever 366 is pivotally connected to the upper end of a sliding lever 368. As can be easily understood from FIG. 15 together with FIG. 17, the sliding lever 368 is mounted vertically slidably in the groove 262 formed in the supporting member 250. The lower end portion of the sliding lever 368 projects downwardly beyond the lower end of the supporting member 250 and a horizontally extending shaft 370 is fixed to this lower end portion. A follower roller 372 received in the cam groove 240 formed in the third annular cam block 236 is rotatably mounted on the inside projecting end of the shaft 370. It will be appreciated therefore that when the rotating support 220 is rotated in the predetermined direction, the sliding lever 368 is caused to ascend or descend vertically in accordance with the track defined by the cam groove 240. When the sliding lever 368 is raised, the arm 348 is caused to pivot counterclockwise about the pin 346 as a center, and when the sliding lever 368 is lowered, the arm 348 is caused to pivot clockwise about the pin 346 (see FIG. 15). When the sliding lever 368 is raised to cause the arm 348 to pivot counterclockwise about the pin 346, the forward end of the hammer tool 358 projects radially inwardly through an opening 374 formed at the lower end portion of the sliding plate 320 (see FIG. 18) and acts on the free end portion of the tear-off tab piece of the closure body.

Figure 19:
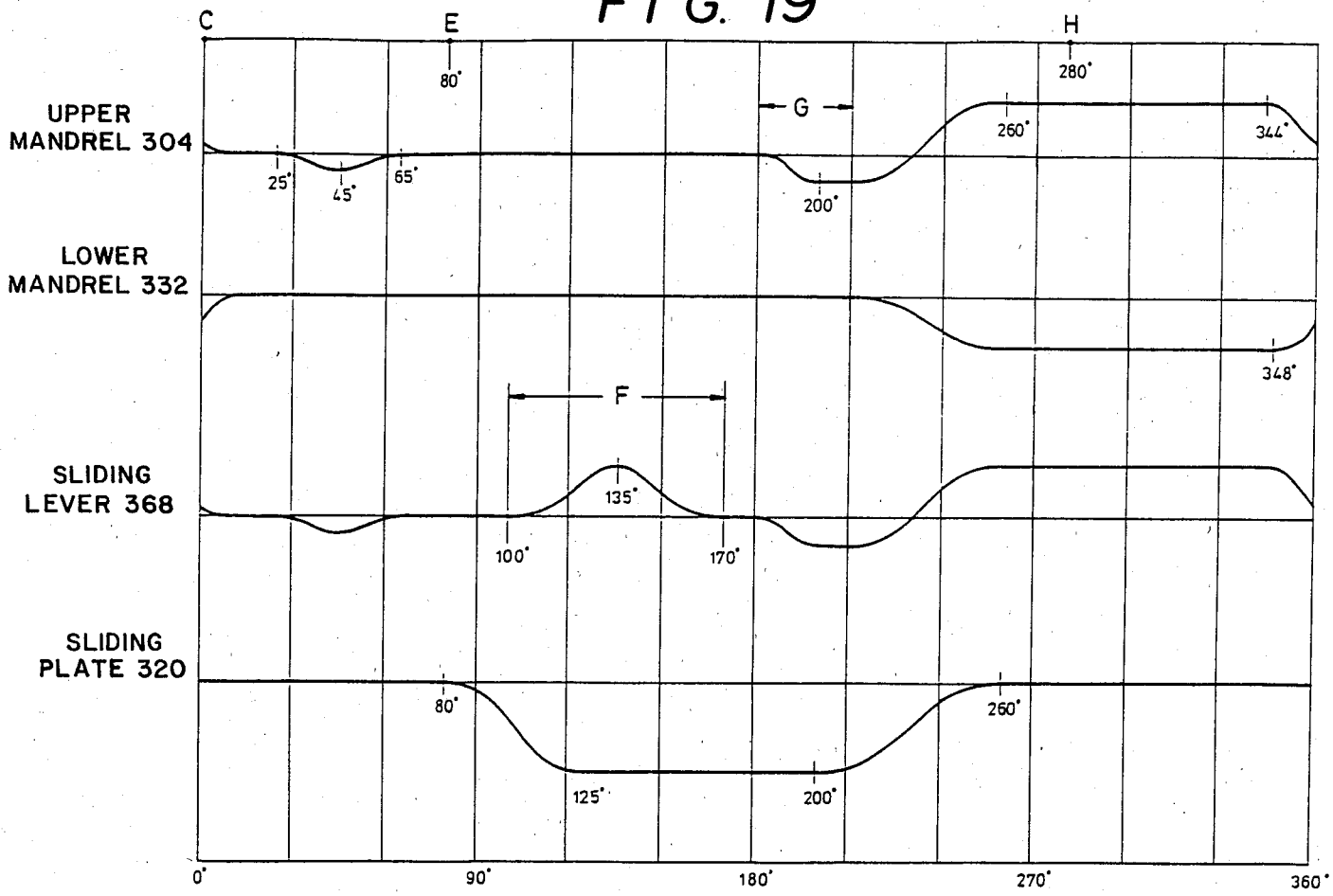
FIG. 19 is a chart showing the track of ascending and descending movement of various composing elements of the pull ring shaping and connecting unit shown in FIG. 15.

FIG. 19 shows the descending and ascending tracks of the square pillar 270 (therefore, the upper rolling tool 300 and the upper mandrel member 304 mounted thereon), the lower mandrel member 332, the sliding plate 320 and the sliding lever 368 of the hammer means 342 in the pull ring shaping and connecting unit 244 when the rotating support 220 rotates through one turn. The rotating angles 0 and 360 degrees in FIG. 19 are defined as the pre-shaped article receiving point C of the pull ring shaping and connecting means 16 in FIG. 2.

Figure 20:
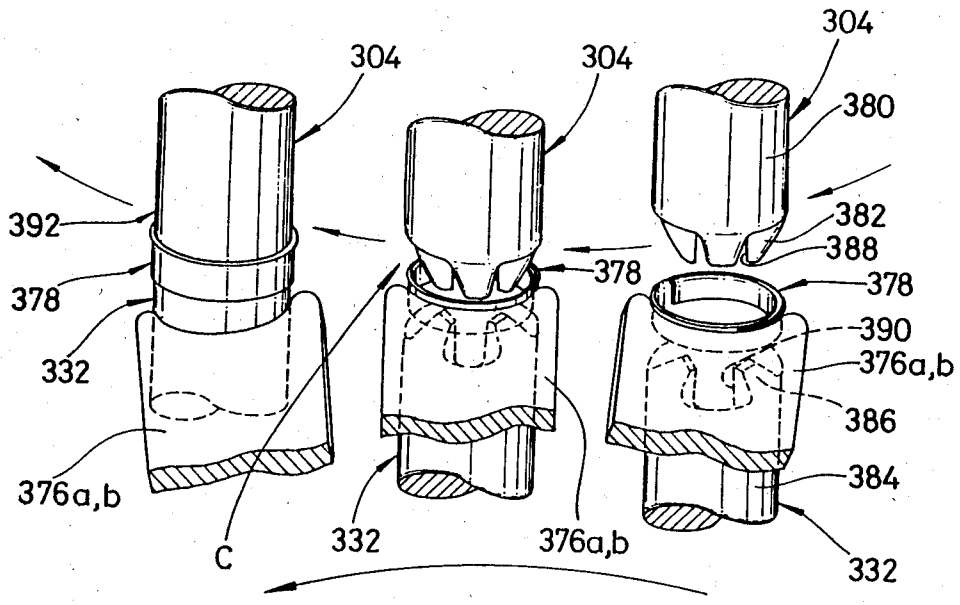
FIG. 20 is a perspecive view of an essential part of the pull ring shaping and connecting unit showing the state of delivery of the pre-shaped article from the pre-shaped article feed means in the pre-shaped article receiving zone.
Figure 21:
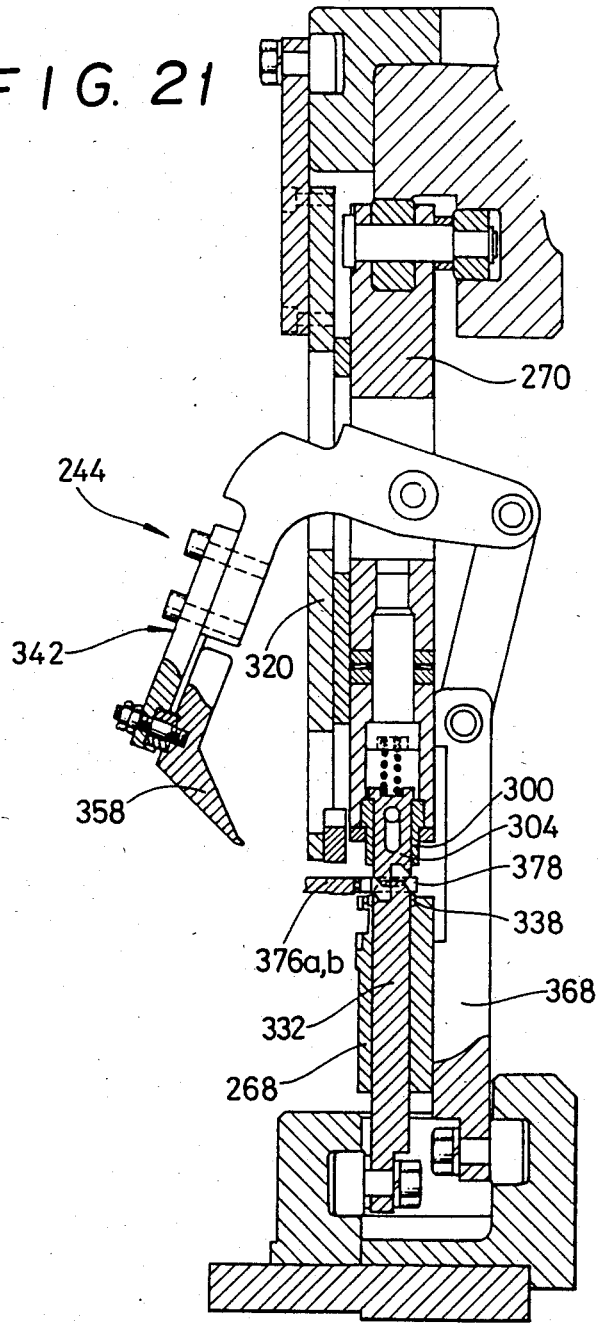
FIG. 21 is a sectional view of an essential part of the pull ring shaping and connecting unit in the pre-shaped article receiving zone.

With reference to FIGS. 19 and 20, the operation of the pull ring shaping and connecting unit 244 will be described below. In FIG. 20, the pull ring and connecting unit 244, move specifically the central axis of the upper mandrel member 304 and the lower mandrel member 332, arrives at the pre-shaped article receiving zone C in synchronism with the arrival, at the pre-shaped article receiving zone C, of the pre-shaped article 378 held by the forward end of the holding member **376*a* or 376*b* of the pre-shaped article feed means 12. Upstream of the pre-shaped article receiving zone C, a sufficient space exists between the lower end of the upper mandrel member 304 and the upper end of the lower mandrel member 332, and the lower end of the upper mandrel member 304 and the upper end of the lower mandrel member 332 are located respectively above and below the pre-shaped article 378 conveyed to the pre-shaped article receiving zone C by the holding member 376*a* or 376*b***.

The configurations of the upper mandrel member 304 and the lower mandrel member 332 are as follows:

As shown in FIG. 20, the upper mandrel member 304 has a cylindrical main portion 380 and a nearly conical lower end portion 382 gradually tapering downwardly. The lower mandrel member 332 has a cylindrical main portion 384 and a nearly conical upper end portion 386 gradually tapering upwardly. The outside diameter of the main portion 380 of the upper mandrel member 304 is substantially equal to the outside diameter of the main portion 384 of the lower mandrel member 332.

The lower end portion 382 of the upper mandrel member 304 and the upper end portion 386 of the lower mandrel member 332 respectively have complementary cuts 388 and 390 which fit into each other. Thus, when the lower end portion 382 of the upper mandrel member 304 is combined fully with the upper end portion 386 of the lower mandrel member 332, the main portion 380 of the upper mandrel member 304 and the main portion 384 of the lower mandrel member 332 are positioned such that one substantially directly follows the other, thereby forming a substantially continuous cylindrical vertical mandrel defined by the upper mandrel member 304 and the lower mandrel member 332, as shown by 392 at the left end portion of FIG. 20.

As will be understood from FIG. 19, when the upper and lower machine members 304 and 332 are rotated in the direction of the arrow from the position shown by solid lines in FIG. 20 and arrive at the pre-shaped article receiving zone C, the square pillar 270 is lowered to move the upper mandrel member 304 downwardly and the lower mandrel member 332 is raised. Thus, in the pre-shaped article receiving zone C, the lower end portion 382 of the upper mandrel member 304 and the upper end portion 386 of the lower mandrel member 332 are inserted from above and below into the pre-shaped article 378 which has arrived at the pre-shaped article receiving zone C in synchronism and are combined with each other partly, as shown at the central portion of FIG. 20 and in FIG. 21. Then, the holding member **376*a* or 376*b* is rotated from the pre-shaped article receiving zone C in the direction of the arrow, and the upper mandrel member 304 and the lower mandrel member 332 rotate about the shaft 214 in the direction of the arrow. Hence, the holding member 376*a* or 376*b* gradually moves away from the upper mandrel member 304 and the lower mandrel member 332. Since at this time, the pre-shaped article 378 exists around the lower end portion 382 of the upper mandrel member 304 and the upper end portion 386 of the lower mandrel member 332 which are partly combined with each other, it is removed from the end of the holding member 376*a* or 376*b* at which the pre-shaped article 378 is magnetically held, and then received by the upper mandrel member 304 and the lower mandrel member 332. When the upper and lower mandrel members 304 and 332 are rotated in the direction from the pre-shaped article receiving zone C, the square pillar 270 is somewhat lowered to lower the upper mandrel member 304 to some extent and the lower mandrel member 332 is raised to some extent. Thus, the lower end portion 382 of the mandrel member 304 is fully combined with the upper end portion 386 of the lower mandrel member 332 to define a substantially continuous cylindrical vertical mandrel 392 as shown at the left end portion of FIG. 20. The pre-shaped article 378 is thus received about the vertical mandrel 392**.

After the pre-shaped article 378 is delivered to the vertical mandrel 392 of the pull ring shaping and connecting unit 244 from the pre-shaped article feed means 12 in the abovementioned manner, the pull ring shaping and connecting unit 244 continues to rotate, and when it arrives at an angular position of about 25 degrees from the pre-shaped article receiving zone C, the square pillar 270 is further lowered until it reaches an angular position of about 45 degrees from the pre-shaped article receiving zone C, as can be understood from FIG. 19. During the downward movement of the pillar 270, the upper mandrel member 304 is unable to descend further because its lower end portion 382 is fully combined with the upper end portion 386 of the lower mandrel member 332 which is not adapted for vertical movement. Hence, the upper mandrel member 304 is raised relative to the pillar 270 against the elastic biasing action of the spring member 306. On the other hand, the upper rolling tool 300 descends together with the pillar 270. During this downward movement of the upper rolling tool 300, the inner peripheral edge portion of the lower surface of the upper rolling tool 300 abuts against the upper edge of the pre-shaped article 378 received about the vertical mandrel 392 and thus lowers the pre-shaped article 378 along the vertical mandrel 392. When the upper rolling tool 300 is lowered to the fixed position, the lower edge of the pre-shaped article 378 thus lowered abuts against the inner peripheral edge portion of the upper surface of the lower rolling tool 338. The downward movement of the upper rolling tool 300 is stopped at this point of time, and therefore, the pre-shaped article 378 is not substantially deformed between the upper rolling tool 300 and the lower rolling tool 338 by the aforesaid lowering of the upper rolling tool 300.

Then, when the pull ring shaping and connecting unit 244 is rotated over an angular range of about 20 additional degrees, namely when it rotates from an angular position of about 45 degrees from the pre-shaped article receiving zone C to an angular position of about 65 degrees, the square pillar 270 is raised to return the upper rolling tool 300 to the original position. At this time, the upper mandrel member 304 is lowered relative to the pillar 270 by the elastic biasing action of the spring member 306, but is not raised or lowered with respect to the lower mandrel member 332. The pre-shaped article 378 lowered to a position at which its edge abuts against the inner peripheral edge portion of the upper surface of the lower rolling tool 338 is maintained at this position without being raised together with the upper rolling tool 300.

Figure 22:
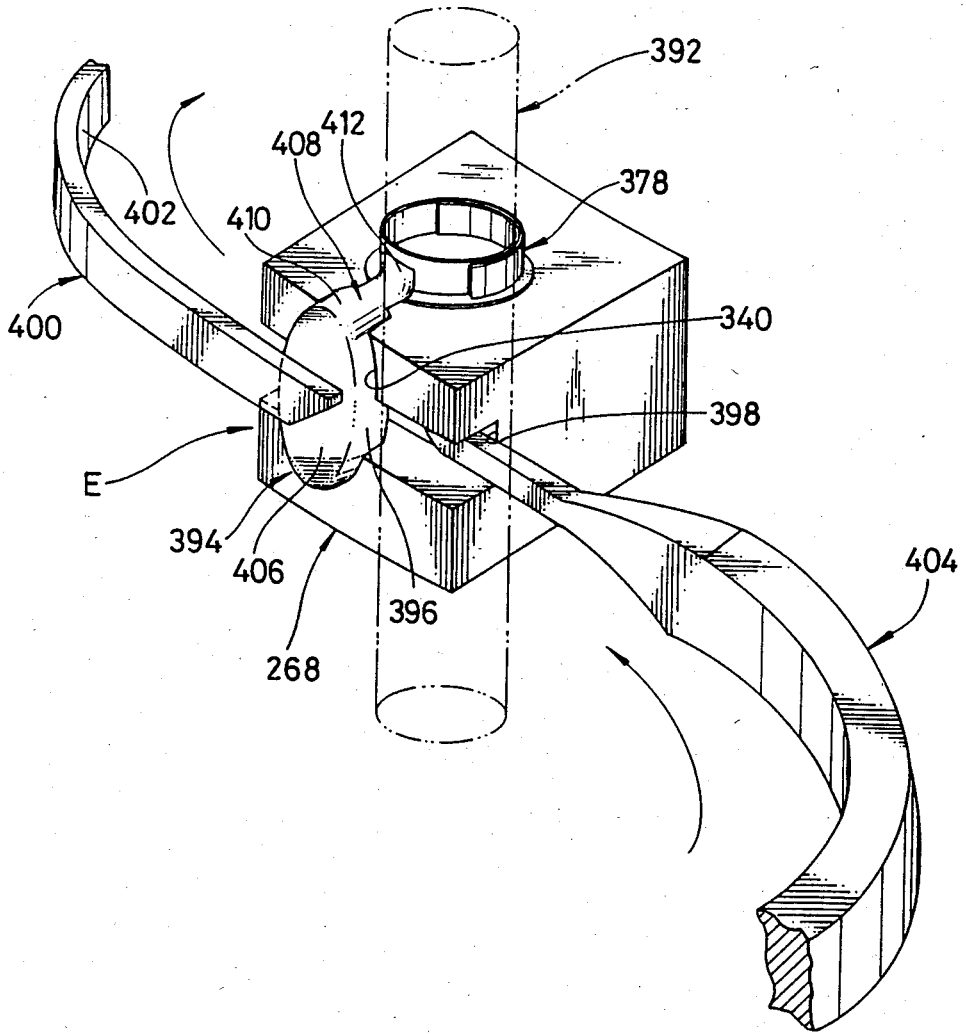
FIG. 22 is a perspective view of an essential part of the pull ring shaping and connecting unit showing the state of delivery of the closure from the closure feed means in the closure receiving zone.

When the pull ring shaping and connecting unit 244 further keeps rotating and reaches an angular position of about 80 degrees from the pre-shaped article receiving zone C, it arrives at the closure body receiving zone E as shown in FIG. 2. In the closure body receiving zone E, the closure body 394 conveyed by the closure body feed means 14 is delivered to the closure body receiving pocket 340 formed in the upper end portion of the outside surface of the outside member 268. As shown in FIG. 22, the closure body receiving pocket 340 is formed at the upper end portion of the outside surface of the outside member 268 of the pull ring shaping and connecting unit 244. The pocket 340 has a nearly circular shape conforming to the outer configuration of the skirt wall 396 of the closure body 394, and its radial depth is about one-half of the height of the skirt wall 396. A groove 398 is formed at a nearly intermediate position in the vertical direction of the pocket 340 extending circumferentially through the outside member 268. The radial depth of the groove 398 following the pocket 340 is much larger than that of the pocket 340. On the other hand, a stationary guide rail 400 extending along the moving path of the outside member 268 is provided in the pull ring shaping and connecting means 208. The stationary guide rail 400 is supported by a support leg not shown, and extends from the closure body receiving zone E to the discharging zone H (FIG. 2) as viewed in the direction of the arrow of the pull ring shaping and connecting unit 244. The inside surface 402 of the stationary guide rail 400 is spaced from the outside surface of the outside member 268 by a predetermined distance corresponding to about one-half of the height of the skirt wall 396 of the closure body 394.

When the pull ring shaping and connecting unit 244 arrives at the closure body receiving zone E, the closure body receiving block 168 (See FIG. 14) secured to the periphery of the rotating conveying table (see FIG. 14) in the closure body feed means 14 also arrives at the closure body receiving zone E in synchronism. Thus, in the closure body receiving zone E, the outside surface of the outside member 268 in the pull ring shaping and connecting unit 244 faces the outside surface of the closure body receiving block in close proximity with each other. As a result, a part of the closure body 394 (i.e., the lower end portion of the skirt wall 396) partly received in the pocket of the closure body receiving block is received in the pocket 340 of the outside member 268. At this time, the downstream end portion of the stationary guide rail 404 disposed in the closure body feed means 14 is positioned in a deep part of the groove 398 formed in the outside member 268. As clearly shown in FIG. 22, the downstream end portion of the stationary guide rail 404 has a reduced thickness and height as compared with the upstream portion so that it can rest in the deep part of the groove 398. On the other hand, the upstream end of the stationary guide rail 400 provided in the pull ring shaping and connecting means 208 rests in a deep part of the groove formed in the closure body receiving block. Hence, the outside member 268 is rotated from the closure body receiving zone E in the direction of the arrow and at the same time the closure body receiving block is rotated from the closure body receiving zone E in the direction shown by an arrow.

When as a result the outside member 268 and the closure body receiving block move away from each other, the closure body 394 is released from its restraining by the stationary guide rail 404 and is removed from the pocket of the closure body receiving block. At the same time the closure body 394 is restrained by the pocket 340 of the outside member 268 by the stationary guide rail 400. The closure body 394 which has been received in the pocket 340 of the outside member 268 is in such a state that its top panel wall 406 is directed radially outwardly and its tear-off tab piece 408 is located uppermost, as is shown in FIG. 22. The tear-off tab piece 408 rests over the upper surface of the outside member 268. More specifically, the base portion 410 of the tear-off tab piece 408 extends radially inwardly along the outside member 268, and its free end portion 412 extends vertically upwardly from the base portion 410. As a result, the free end portion 412 of the tear-off tab piece 408 is superimposed on the outside of that portion of the pre-shaped article 378 received about the vertical mandrel 392 which is located radially outwardly. The boundary portion between the base portion 410 and the free end portion 412 is located at substantially the same height as the lower edge of the pre-shaped article 378, and the projecting length of the free end portion 412 is slightly smaller than the width of the pre-shaped article 378. Accordingly, the edge of the free end portion 412 is located somewhat below the upper edge of the pre-shaped article 378. When the pull ring shaping and connecting unit 244 keeps rotating in the direction of arrow and the outside member 268 is conveyed from the closure body receiving zone E in the direction of arrow, the closure body 394 received in the pocket 340 is also conveyed in the direction of the arrow together with the outside member 268. During this conveyance, the closure body 394 is maintained in the aforesaid state with respect to the outside member 268. By the centrifugal force acting on the closure body 394 owing to its rotating in the direction of arrow, the closure body 394 tends to be displaced radially outwardly from the pocket 340, but its radially outward removal from the pocket 340 is hampered by the stationary guide rail 400.

Figure 23:
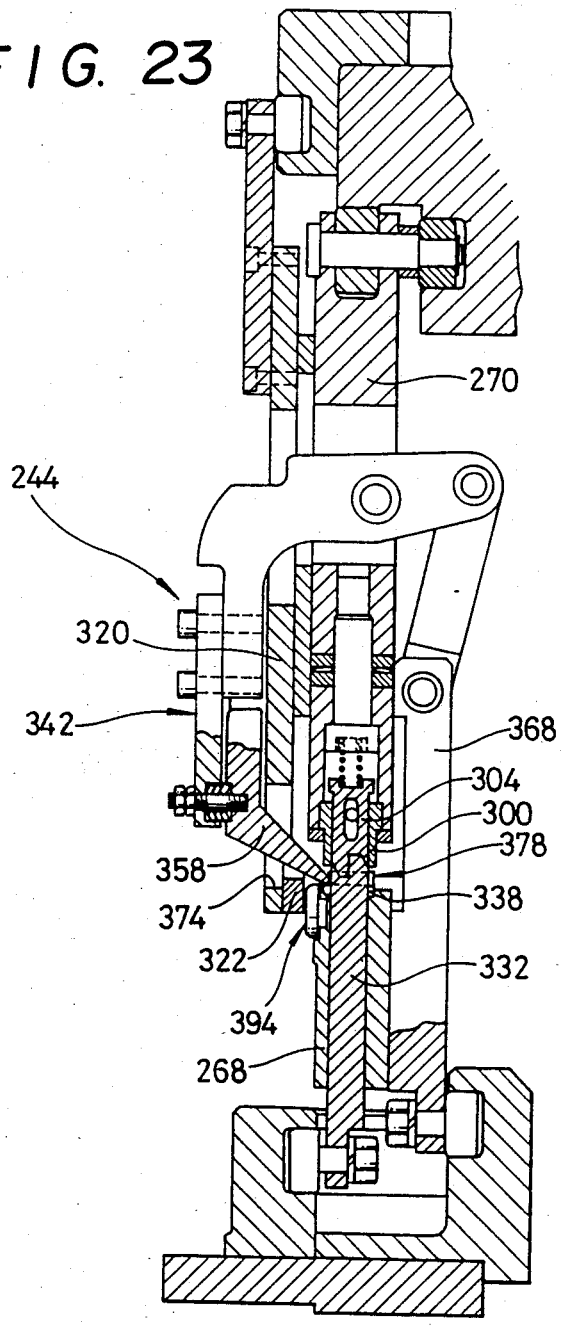
FIG. 23 is a sectional view of an essential part of the pull ring shaping and connecting unit in the bending zone.
Figure 24:
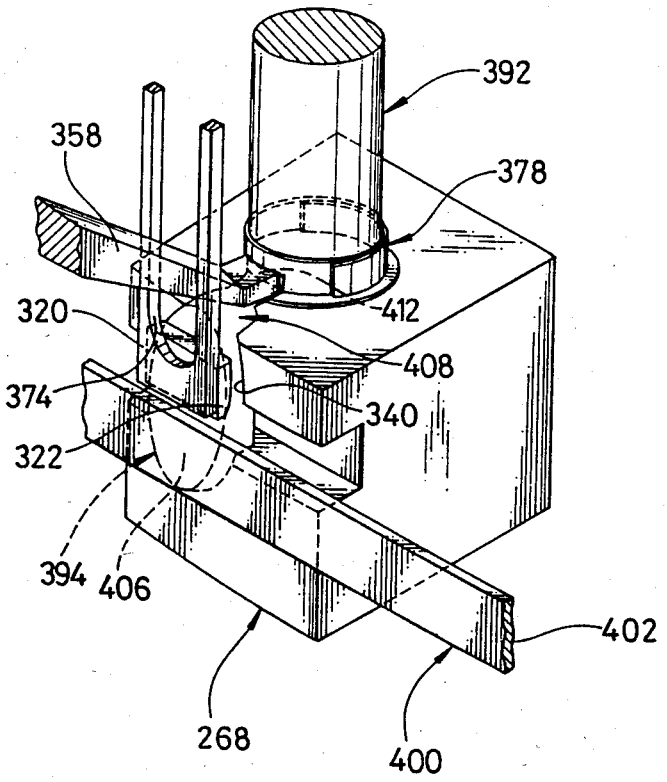
FIG. 24 is a perspective view of an essential part of the pull ring shaping and connecting unit in the bending zone.

As can be seen with reference to FIG. 19, the sliding plate 320 is lowered while the pull ring shaping and connecting unit 244 is rotated over an angular range of about 45 degrees from the closure body receiving zone E in the direction of arrow. By this downward movement, the sliding plate 320 is displaced from its non-operative position shown in FIGS. 15 and 18, and is held at its operating position shown in FIGS. 23 and 24. In FIGS. 23 and 24, when the sliding plate 320 has been lowered to its operating position, its lower end is located downwardly beyond the uppermost part of the closure body 394 received in the pocket 340 of the outside member 268 and thus faces the upper half portion of the top panel wall 406 of the closure body 394. As result, the pressing member 322 made of a flexible material such as synthetic rubber and bonded to the inside surface of the lower end of the sliding plate 320 is pressed against the upper half of the outside surface of the top panel wall 406 of the closure body 394. As shown in FIG. 19, the sliding plate 320 which has been lowered to its operating position shown in FIGS. 23 and 24 is kept at the operating position until the pull ring shaping and connecting unit 244 moves to an angular position of about 200 degrees from the pre-shaped article receiving zone C. While the pull ring shaping and connecting unit 244 rotates from this angular position over an angular range of about 50 degrees, the sliding plate 320 is raised from the operating position shown in FIGS. 23 and 24 and returned to its non-operating position shown in FIGS. 15 and 18.

As can be seen from FIG. 19, except when the pull ring shaping and connecting unit 244 passes through the bending zone F (FIG. 2), the sliding lever 368 of the hammer means 342 is raised and lowered incident to the raising and lowering of the square pillar 270, and therefore, the arm 348 of the hammer means 342 is not pivoted about the pin 346. When the pull ring shaping and connecting unit 244 passes through the bending zone F, the square pillar 270 is not raised or lowered, but the sliding lever 368 of the hammer means 342 is raised and then lowered. More specifically, while the pull ring shaping and connecting unit 244 rotates from an angular position of about 100 degrees to an angular position of about 135 degrees as viewed from the pre-shaped article receiving zonc C, the sliding lever 368 is raised, and while the unit 244 then rotates from the angular position of about 135 degrees to an angular position of about 170 degrees as viewed from the pre-shaped article receiving zone C, the sliding lever 368 is lowered to its original position. It will be easily understood from a comparison of FIGS. 15 and 23 that when the sliding lever 368 of the hammer means 342 is raised, the arm 348 is pivoted counterclockwise about the pin 346 (FIG. 15). When the pull ring shaping and connecting unit 244 moves to the angular position of about 135 degrees as viewed from the pre-shaped article receiving zone C, the raising of the sliding lever 368 causes the arm 348 to pivot to the position shown in FIGS. 23 and 24. As a result, the forward end portion of the hammer tool 358 mounted on the end of the arm 348 projects radially inwardly through the opening 374 formed at the lower end portion of the sliding plate 320, and strikes the free end portion 412 of the tear-off tab piece 408 of the closure body 394 and the pre-shaped article 378 to press them against the vertical mandrel 392. The end or the striking surface, of the hammer tool 358 is formed in an arcuate shape having a curvature corresponding to the curvature of the peripheral surface of the vertical mandrel 392. Accordingly, that free end portion 412 of the tear-off tab piece 408 is bent widthwise by the striking of the hammer tool 358 in substantially the same curvature as the curvature of the periphery of the vertical mandrel 392, and therefore as the curvature of the outside surface of the pre-shaped article 378 (the curvature in the longitudinal direction), and is laid fully intimately upon the outside surface of the pre-shaped article 378 over its entire widthwise direction. Thereafter, the pull ring shaping and connecting unit 244 is rotated from the angular position of about 135 degrees to an angular position of about 170 degrees, as viewed from the pre-shaped article receiving zone C, and during this time, the sliding lever 368 is lowered. As a result, the arm 348 is pivoted clockwise about the pin 346 (FIG. 23), and the hammer tool 358 is returned from its striking position shown in FIGS. 23 and 24 to its position shown in FIG. 15.

While the pull ring shaping and connecting unit 244 passes through the pull ring shaping and connecting zone G after going past the bending zone F [namely, while it rotates from an angular position of about 180 degrees to an angular position of about 210 degrees as viewed from the pre-shaped article receiving zone C (FIG. 2)], the upper rolling tool 300 and the lower rolling tool 338 cooperatively act to shape the pre-shaped article 378 into a pull ring and rollingly connect it to the free end portion 412 of the tear-off tab piece 408 of the closure body 394 (FIG. 1). When the upper edge portion of the pre-shaped article 378 is rolled in a nearly arcuate shape, it surrounds the free end portion 412 of the tear-off tab piece 408 and the free end portion 412 of the tear-off tab piece 408 is rolled together as the rolling of the upper edge portion of the pre-shaped article 378 proceeds. As a result, the pre-shaped article 378 is rolled in the pull ring having a nearly circular cross-sectional shape and simultaneously, the pull ring is rolled and connected to the free end portion 412 of the tear-off tab piece 408.

While the pull ring shaping and connecting unit 244 passes the pull ring shaping and connecting zone G and rotates from an angular position of about 210 degrees to an angular position of about 260 degrees as viewed from the pre-shaped article receiving zone C (FIG. 2), the square pillar 270 is raised and the upper rolling tool 300 is returned to the position shown in FIG. 15, as can be seen from FIG. 19. In the early stage of this rising of the square pillar 270, the upper mandrel member 304 descends relative to the pillar 270 by the elastic biasing action of the spring member 306, but after the lower surface of the flange formed at the upper end of the upper mandrel member 304 abuts against the upper end surface of the upper rolling tool 300, the upper mandrel member 304 ascends together with the upper rolling tool 300 incident to the rising of the square pillar 270. Thus, the upper mandrel member 304 moves upwardly away from the shaped pull ring and returns to the position shown in FIG. 15. When the pull ring shaping and connecting unit 244 rotates from an angular position of about 210 degrees to an angular position of about 260 degrees as viewed from the pre-shaped article receiving unit, the lower mandrel member 332 is lowered and moves downwardly away from the shaped pull ring and finally returns to the position shown in FIG. 15. As a result, the pull ring shaping and connecting unit 244 returns to the state shown in FIG. 15. The pull ring shaping and connecting unit 244 holds the closure 394 having the pull ring connected thereto.

When the pull ring shaping and connecting unit 244 further rotates and reaches an angular position of about 280 degrees as viewed from the pre-shaped article receiving zone C, it arrives at the discharging zone H (FIG. 2).

Moreover, with reference to FIGS. 25 and 26, the closure transfer means which forms an important part of the apparatus of this invention will now be described in detail.

Figure 25:
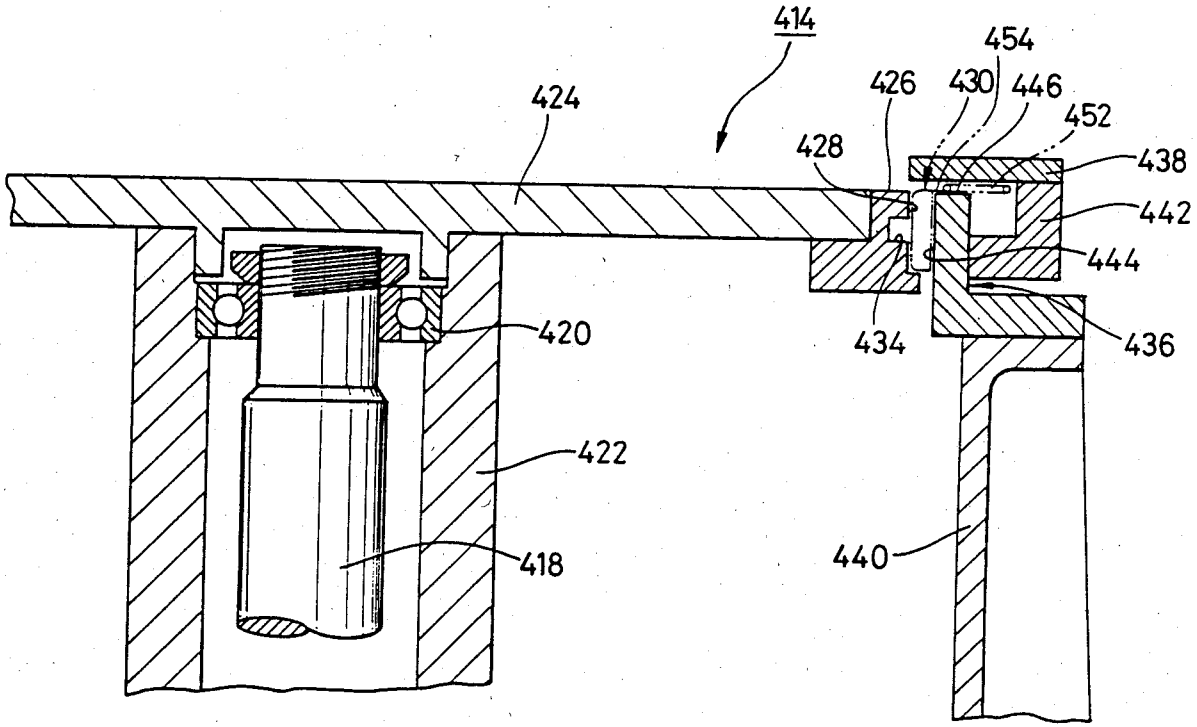
FIG. 25 is a sectional side view of an important part showing an embodiment of the closure transfer means for transferring the closure to the means to strengthen the connected part of the closure connected to the pull ring which forms an important part of this invention.
Figure 26:
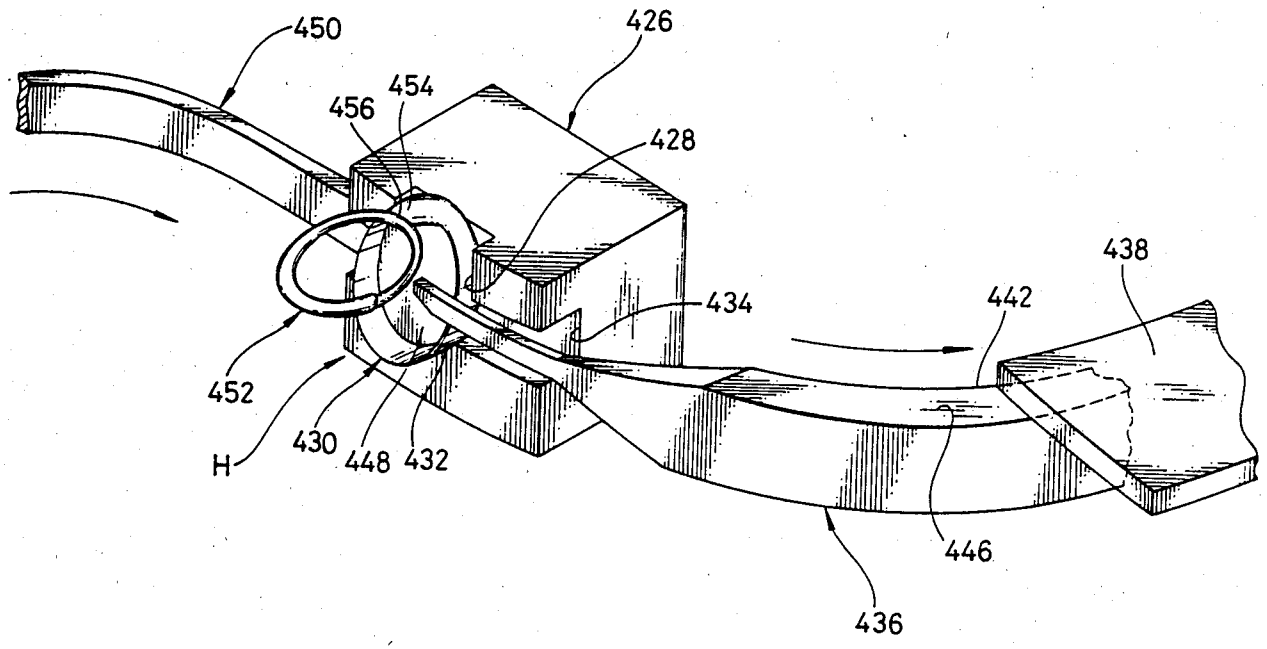
FIG. 26 is a perspective view of an important part of the closure transfer means showing the state of delivery of a closure to which a pull ring is connected at the pull ring shaping and connecting means.

As shown in FIGS. 2, 25 and 26, the closure transfer means 414 acts to suitably collect and hold a container closure obtained by uniting a pre-shaped article fed from the pre-shaped article feed means 12 and a container closure fed from the closure feed means 14 and connecting a pull ring to the closure simultaneously with shaping the pull ring in the pull ring shaping and connecting means 16 and to convey the closure to the next connection strengthening means 20. The container closure transfer means 414 in this embodiment includes a substantially vertically extending stationary support shaft 418 and around the support shaft 418 is rotatably mounted a hollow cylindrical member 422 through a bearing member 420. A rotating conveying table 424 is fixed to the upper end of the hollow cylindrical member 422. The hollow cylindrical member 422 is suitably connected to a driving power source and is constructed such that it connectingly rotates the rotating conveying table 424 in a predetermined direction. On the peripheral surface of the rotating conveying table 424 are fixed a plurality of closure receiving blocks 426 arranged at equal intervals in the circumferential direction. As shown in FIG. 26, a closure receiving pocket 428 is formed at the upper end portion of the outside surface of each block 426. The pocket 428 has a nearly circular shape conforming to the outer configuration of the skirt wall 432 of the closure 430, and its radial depth is nearly one-half of the height of the skirt wall 432. At a nearly intermediate position in the vertical direction of the pocket 428, a groove 434 is formed extending circumferentially through the block 426. The radial depth of the groove 434 which follows the pocket 428 is set to be much larger than that of the pocket 428. The closure transfer means 414 in this embodiment further comprises a stationary guide rail 436 extending along the peripheral surface of the rotating conveying table 424. The stationary guide rail 436 is supported by a support leg 440, and extends from the discharging zone H to the transfer zone I as viewed in the rotating direction of the conveying table 424 (FIG. 2). The inner surface 444 of the stationary guide rail 436 is spaced from the peripheral surface of the block 426 by a predetermined distance corresponding to about one-half of the height of the skirt wall 432 of the closure 430. The upper surface 446 of the stationary guide rail 436, except its upstream end portion located in the discharging zone H and its downstream end portion located in the transfer zone I, is formed in a flat surface situated at substantially the same height as the upper surface of the block 426.

In this embodiment, an additional upper stationary guide rail 438 is also provided which extends from a position somewhat downstream of the discharge zone H as viewed in the rotating direction of the rotating transfer disc 424 to the transfer zone I, as shown in FIGS. 25 and 26. As shown in FIG. 25, a plurality of support members 442 (only one of which is shown in FIG. 25) are fixed at intervals to the outside surface of the stationary guide rail 436. The radially outward portion of the upper stationary guide rail 438 is fixed to the top surface of the support member 442. The lower surface of the radially inward portion of the upper stationary guide rail 438 is located immediately above the pull ring 452 connected to the closure 430 conveyed while being received in the pocket 428, thereby preventing the upward displacement of the closure 430 and the pull ring 452 connected to it. The operation of the closure transfer means 414 constructed in the above mentioned manner is described below.

With reference to FIG. 26, the closure receiving block 426 rotated in the direction of arrow by the rotation of the rotating conveying table 424 arrives at the discharging zone H in synchronism with the pull ring shaping and connecting means 16. In the discharging zone H, the pocket disposed on the pull ring shaping and connecting means 16 faces the pocket 428 of the block 426 in close proximity with each other. At this time, a part of the closure 430 (the top panel wall 448 and the upper end portion of the skirt wall 432), a part of which (the lower end portion of the skirt wall 432) is received in the pocket of the outside member, is inserted in the pocket 428 of the block 426. At this time, the downstream end portion of the stationary guide rail 450 provided in the pull ring shaping and connecting means is positioned in a deep part of the groove 434 formed in the block 426. On the other hand, the upstream end portion of the stationary guide rail 436 provided in the closure transfer means 414 positioned at a deep part of the groove formed in the outside member of the pull ring shaping and connecting means 16. As a result the upstream end portion of the stationary guide rail 436 has a reduced thickness and height so that it can be positioned in the deep of the groove (FIG. 26).

Accordingly, when the block 426 and the outside member of the pull ring shaping and connecting means 16 move away from each other as a result of the rotation of block 426 from the discharging zone H in the predetermined direction and the rotation of the pull ring shaping and connecting means 16 from the discharging zone H in the predetermined direction of the closure 430 is released from its restraining by the stationary guide rail 450 and removed from the outside member, then the closure 430 is restrained by the pocket 428 of the block 426 by the stationary guide rail 436, and the closure 430 and the pull ring 452 connected thereto are smoothly delivered to the block 426. The closure 430 and the pull ring 452 connected thereto which have been delivered to the block 426 are in such a state that the top panel wall 448 of the closure 430 faces radially inwardly and the tear-off tab piece 454 is located uppermost, and the pull ring 452 connected to the free end portion 456 of the tear-off tab piece 454 projects radially outwardly. Thereafter, following the rotation of the block 426, the closure 430 and the pull ring 452 connected thereto are conveyed from the discharging zone H to the transfer zone I (FIG. 2). At this time as shown in FIG. 25, the base portion of the tear-off tab piece 454 of the closure 430 and the radially inward portion of the pull ring 452 connected to the free end portion of the tear-off tab piece 454 are kept in contact with, and supported by, the upper surface of the stationary guide rail 436, whereby the closure 430 and the pull ring 452 connected thereto are prevented from turning about the central axis of the closure 430, and the stable transfer of the closure 430 up to its arrival at the transfer zone I can be realized.

Further, with reference to FIGS. 27 to 31, the connection strengthening means which forms an important part of the apparatus of this invention will now be described in detail.

Figure 27:
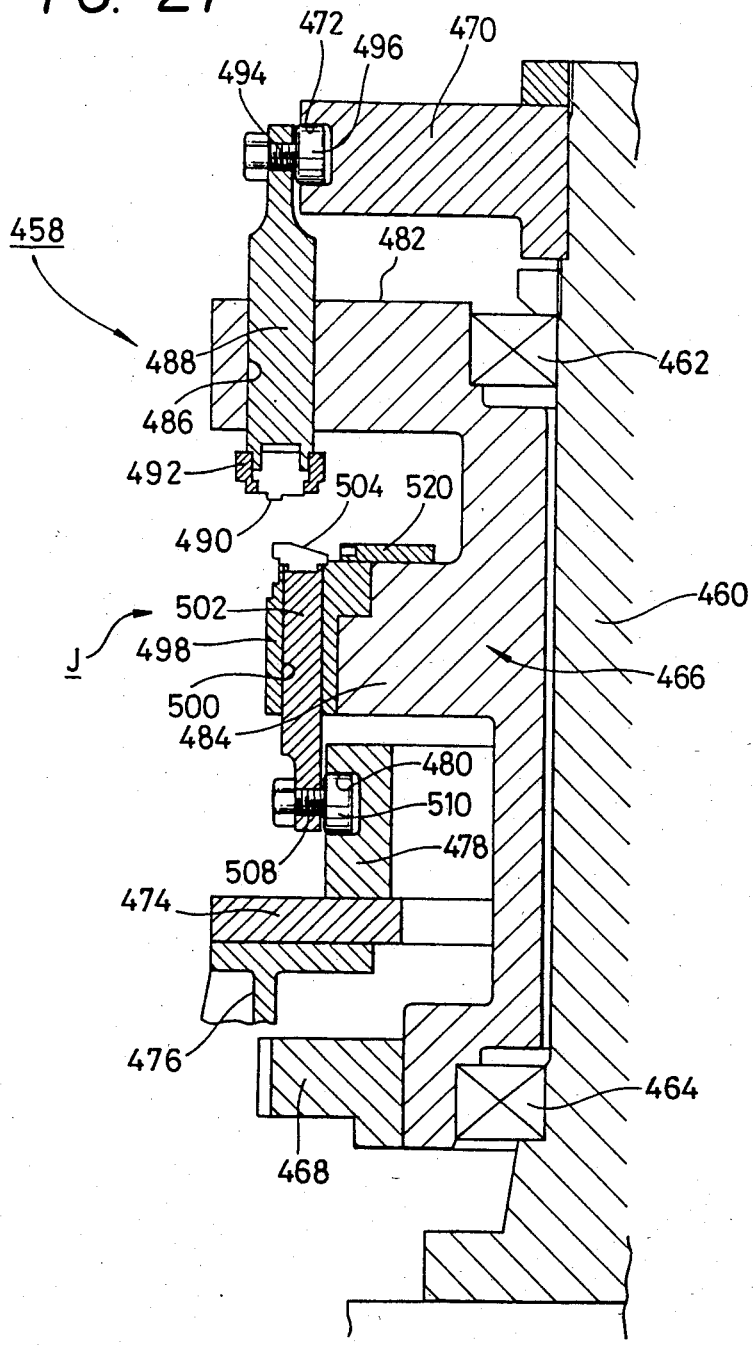
FIG. 27 is a sectional side view of an important part showing one embodiment of the connection strengthening means to strengthen the connected part connected a pull ring thereto which forms an important part of the apparatus of this invention.

In FIG. 27, the connection strengthening means 458 includes a substantially vertically extending stationary support shaft 460, and around the support shaft 460 is rotatably mounted a rotating suport 466 through bearing members 462 and 464. To the lower end portion of the rotating support 466 is fixed a large input gear 468, through which the rotating support shaft 466 is suitably connected to a drive power source so that the rotating support 466 is continuously rotated in the predetermined direction. An upper annular cam block 470 is fixed to the upper end portion of the support shaft 460, and an annular cam groove 472 is formed on the peripheral surface of the upper annular cam block 470. The connection strengthening means 458 in this embodiment further comprises an annular stationary support plate 47 around, and spaced from, the lower end portion of the rotating support 466. The stationary support plate 474 is supported by a support leg 476 and to its upper surface a lower annular cam block 478 is fixed. An annular cam groove 480 is formed on the peripheral surface of the lower annular cam block 478.

A plurality of connection strengthening units are provided circumferentially at predetermined intervals on the rotating support member 466.

The rotating support 466 has an upper annular flange 482 formed on its upper end portion and an intermediate annular flange 484 formed at its intermediate portion in the vertical direction. A plurality of circumferentially spaced holes 486 having a circular cross section are formed on the upper annular flanges 482 extending therethrough axially. A cylindrical member 488 whose main portion has a circular shape conforming to the circular cross section of each hole 486 is received in each of the holes 486 so that it is slidable vertically although it cannot rotate about its axis. An upper pressing tool 490 is fixed to the lower end of the cylindrical member 488 which projects downwardly beyond the lower surface of the upper annular flange 482. A blind bore circular in cross section is formed at the lower end of the cylindrical member 488, and at the upper end portion of the pressing tool 490 are formed a cylindrical extension and an annular flange located beneath it. The upper end portion of the upper pressing tool 490 is inserted in the blind bore of the cylindrical member 488. In this case, the annular flange of the upper pressing tool 490 is held and fixed between the annular shoulder portion formed on the inner surface of the annular retaining member 492 threadably received by the lower end of the cylindrical member 488 and the lower end surface of the cylindrical member 488.

Figure 28:
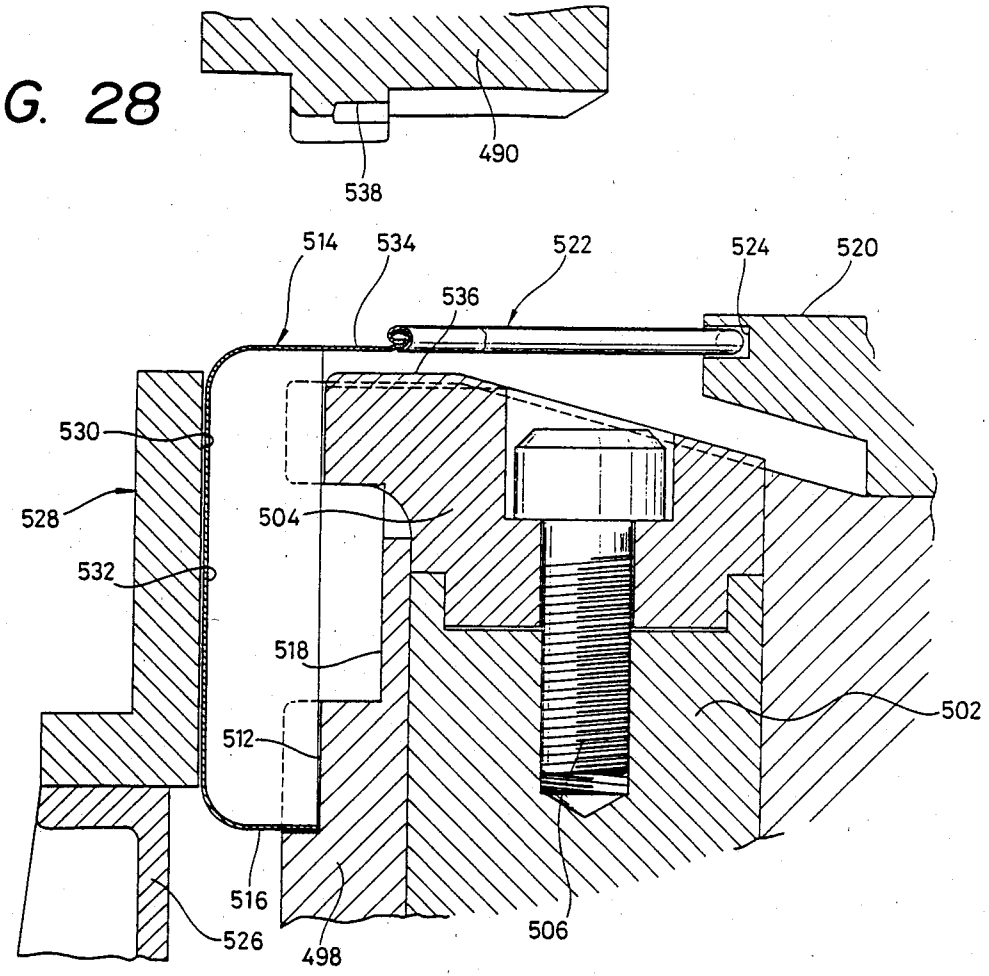
FIGS. 28 and 29 are enlarged sectional view of important part showing the cooperative action of the upper pressing tool and the lower pressing tool in the connection strengthening means shown in FIG. 27.

On the other hand, a horizontally extending shaft 494 is fixed to the upper end portion of the cylindrical member 488 extending upward beyond the upper surface of the upper annular flange 482. A follower roller 496 received in the cam groove 472 formed in the upper annular cam block 470 is rotatably mounted on the inner projecting end portion of the shaft 494. It will be appreciated therefore that when the rotating support 466 is rotated in the predetermined direction, the cylindrical member 488 and the upper pressing tool 490 fixed to it are raised and lowered in the vertical direction in accordance with the track defined by the annular cam groove 472. A plurality of circumferentially spaced supporting blocks 498 are fixed to the peripheral surface of the intermediate annular flange 484 of the rotating support 466. The angular position of each of the supporting blocks 498 is kept in agreement with the angular position of the cylindrical member 488 mounted on an upper annular flange 482. Each of the supporting blocks 498 has formed therein a hole 500 of a circular cross-sectional shape extending therethrough vertically. A cylindrical member 502 whose main portion has a circular cross sectional shape corresponding to the circular cross section of the hole 500 is received in the hole 500 so that it is slidable vertically although it cannot rotate about its axis. A lower pressing tool 504 is fixed to the upper end of the cylindrical member 502 by means of a setscrew 506 (FIG. 28). The lower pressing tool 504 is disposed to cooperate with the upper pressing tool 490. On the other hand, a horizontally extending shaft 508 is fixed to the lower end of the cylindrical member 502 projecting downwardly beyond the lower surface of the supporting blocks 498. A follower roller 510 received in the annular cam groove 480 of the lower annular cam block 478 is rotatably mounted on the inward projecting end portion of the shaft 508. It will be appreciated therefore that when the rotating support 466 is rotated in the predetermined direction, the cylindrical member 502 and the lower pressing tool 504 fixed thereto are vertically raised and lowered in accordance with the track defined by the annular cam groove 480.

Figure 29:
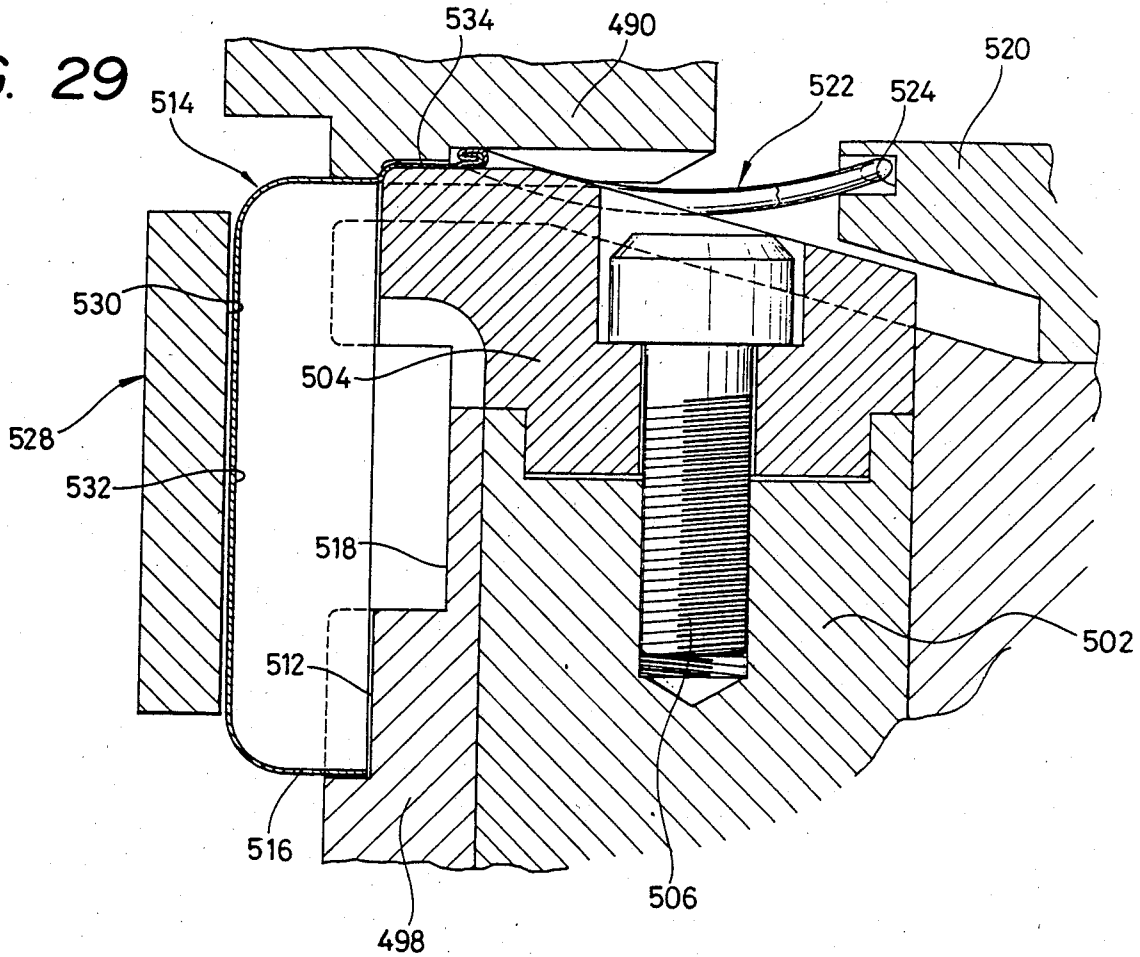

In FIGS. 27 to 29, the supporting blocks 498 has formed at its outside surface a pocket 512. The pocket 512 has a nearly circular shape conforming to the outer configuration of the skirt wall 516 of the container closure 514, and its radical depth is nearly one half of the height of the skirt wall 516. At a nearly intermediate portion in the vertical direction of the pocket 512, a groove 518 is formed extending circumferentially through the support block 498. The radial depth of the groove 518 which follows the pocket 512 is set to be much larger than that of the pocket 512.

Figure 30:
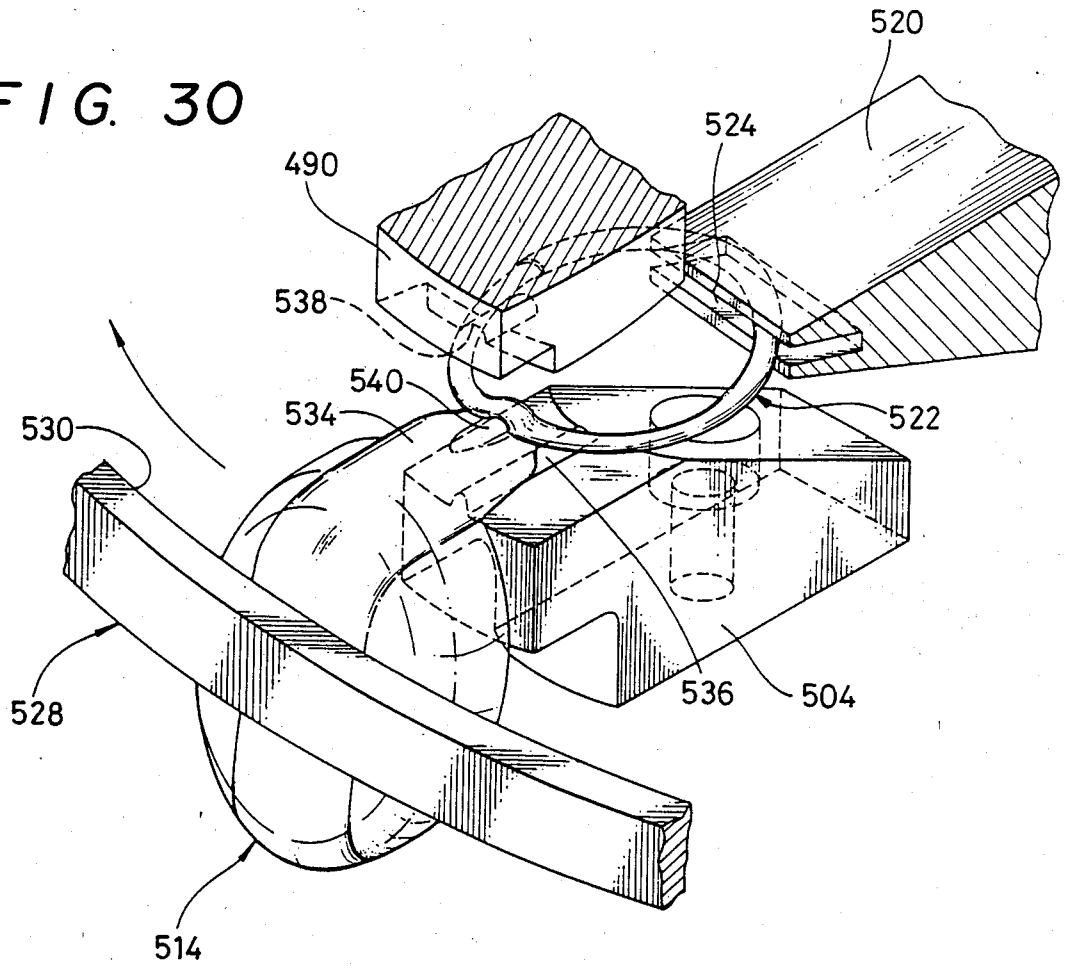
FIG. 30 is an enlarged perspective view of an important part showing the cooperative action of the upper pressing tool and the lower pressing tool in the connection strengthening means shown in FIG. 27.

The upper surface of the intermediate annular flange 484 of the rotating support 466 is further fixed to a guide member 520 corresponding to each of the supporting block 498. As shown in FIG. 30, the guide member 520 is positioned radially inwardly of the lower pressing tool 504, and on its peripheral surface an arcuate shaped groove 524 having a curvature corresponding to the curvature of the pull ring 522 connected to the closure 514 is formed.

As shown in FIGS. 28 to 31, the connection strengthening means 458 of this embodiment includes a stationary guide rail 528 supported on the stationary support plate 474 by a support leg 526. The stationary guide rail 528 extends from the transfer zone I to the delivery zone K in the direction of the arrow (FIG. 2) and opposite the peripheral surface of the intermediate flange 484. The inner surface 530 of the stationary guide rail 528 is spaced from the outside surface of the supporting block 498 by a pre-determined distance corresponding to about one-half of the height of the skirt wall 516 of the closure body 514.

The operation of the connection strengthening means 458 constructed as above is described below.

The rotation of the rotating support 466 in the predetermined direction causes the supporting block 498 to arrive at the transfer zone I (FIG. 2) in synchronism with the closure receiving block of the closure transfer means 18. In the transfer zone I, the outside surface of the supporting block 498 faces the outside surface of the closure receiving block of the closure transfer means 18 in close proximity to each other, and the closure 514 and the pull ring 522 connected thereto are delivered from the closure receiving block to the supporting block 498.

In this case, a part the closure 514, a part of which is received in the pocket of the closure receiving block (the lower end portion of the skirt wall 516), is inserted into the pocket 512 of the supporting block 498.

At this time, the downstream end portion of the stationary guide rail (not shown) provided in the closure transfer means 18 is positioned in the deep part of the groove 518 formed on the supporting block 498. On the other hand, the upstream end portion of the stationary guide rail 528 provided in the supporting block 498 is positioned in the deep part of the groove formed on the closure receiving block of the closure transfer means 18 (not shown).

After that, when the supporting block 498 and the closure receiving block move away from each other as a result of the rotation of the supporting block from the transfer zone I to the direction of an arrow and the rotation of the closure receiving block from the transfer zone I to the direction of an arrow, the closure 514 and the pull ring 522 connected thereto are removed from the pocket of the closure receiving block and are restrained by the pocket 512 of the supporting block 498 by the stationary guide rail 528. As a result, the closure 514 and the pull ring connected thereto received in the pocket 512 of the supporting block 498 direct the top panel wall 532 radially outwardly and position the tear-off tab piece 534 uppermost, further extend the pull ring 522 radially inwardly over the upper surface of the supporting block 498 as shown in FIGS. 28 and 30. At this time, the end portion of the pull ring 522 is positioned in the arcuate groove 524 formed on the peripheral surface of the guiding member 520, and the closure 514 and the pull ring 522 connected thereto are maintained accurately in the required state with respect to the supporting block 498 as shown in FIG. 30.

The closure 514 and the pull ring 522 connected thereto, which are held by the supporting block 498, are conveyed from the transfer zone I in the direction of arrow (FIG. 2) when the supporting block 498 passes through the pressure deforming zone J, whereupon the cylindrical member 488 is lowered and the cylindrical member 502 is raised (FIG. 27). As a result, the upper pressing tool 490 fixed to the lower end of the cylindrical member 488 is lowered to the lowered position shown in FIG. 29 from its raised position shown in FIG. 28. Simultaneously, the lower pressing tool 504 fixed to the upper end of the cylindrical member 502 is raised to its raised position shown in FIG. 29 from its lowered position shown in FIG. 28. Consequently, the connected part between the tear-off tab piece 534 of the closure 514, and the pull ring 522 of the closure 514 and its vicinity are deformed by the resulting pressure (FIG. 30). As can be easily understood from FIG. 30, the connected part between the tear-off tab piece 534 of the closure 514 and the pull ring 522 are collapsed by the press deformation.

In this case, by the cooperative action of the raised portion 536 formed on the upper surface of the lower pressing tool 504 and the depressed portion 538 formed on the lower surface of the upper pressing tool 490, a reinforcing rib 540 of a semicircular cross sectional shape is formed in the connected part and a part of the tear-off tab piece 534 following that part.

Figure 31:
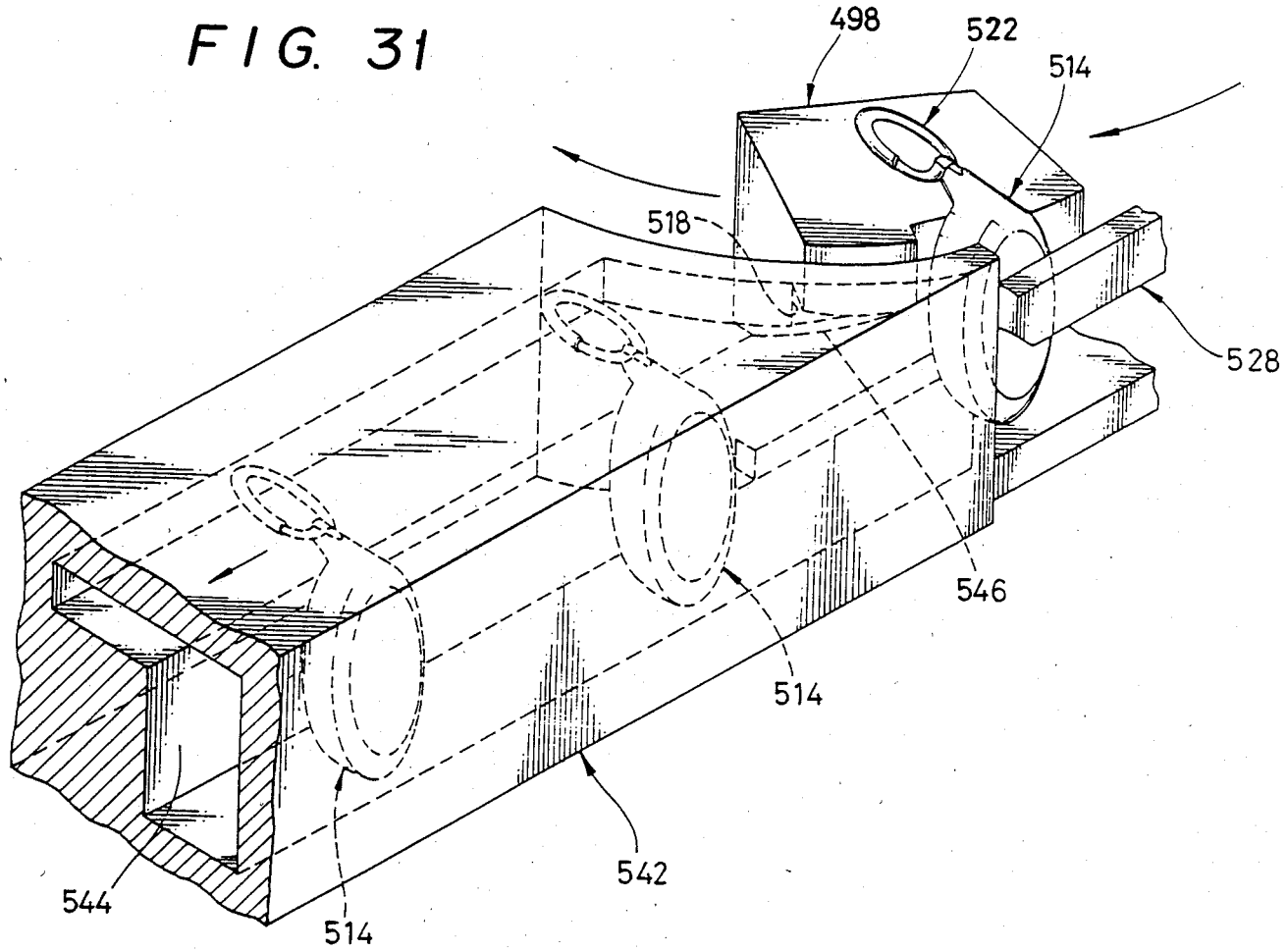
FIG. 31 is a perspective view of an important part showing the delivery mechanism of a container closure and a pull ring connected thereto in the delivery zone of the connection strengthening means shown in FIG. 27.

When the closure 514 maintained in the supporting block 498 and the pull ring connected thereto pass the press deformation zone J, the cylindrical member 488 is raised and the cylindrical member 502 is lowered (FIG. 27). As a result, the upper pressing tool 490 fixed to the lower end of the cylindrical member 488 is returned to its raised position shown in FIG. 28, from its lowered position shown in FIG. 29 and simultaneously the lower pressing tool 504 fixed to the upper end of the cylindrical member 502 is returned to its lowered position shown in FIG. 28 from its raised position shown in FIG. 29. Thereafter, the closure 514 and the pull ring 522 connected thereto, which are held by the supporting block 498, are conveyed to the delivery zone K (FIG. 2). In the delivery zone K, the closure 514 and the pull ring 522 connected thereto, which are held by the supporting block 498, are sent to a feed chute 542 as shown in FIG. 31. The feed chute 542 may be made of a transparent or semitransparent plastic material, and a passage 544 having an L-shaped cross section permitting the passage of the closure 514 and the pull ring 522 connected thereto is formed in the feed chute. The upstream end of the chute 542 is positioned in the delivery zone K. At the upstream end of the feed chute 542 a guide piece 546 is projectingly positioned in a deep part of the groove 518 provided on the supporting block 498 when the supporting block 498 arrives at the delivery zone K. On the other hand, the stationary guide rail 528 terminates in the delivery zone K. When the supporting block 498 rotates further in the direction of arrow from the delivery zone K, the closure 514 and the pull ring 522 connected thereto are released from their restraint by the stationary guide rail 528 whereby they move away from the supporting block 498 and are introduced into the passage 544 of the feed chute 542 through the guuide piece 548. The closure 514 and the pull ring 522 which have thus been introduced into the passage 544 of the chute 542 are sent to a desired site (for example, a site of collection and packing) by the force of gravity acting on themselves or by the action of an air stream supplied to the passage 544 through a feed passage not shown.

However, in the pull ring shaping and connecting apparatus constructed as above, in the case where the closure feed means 14 does not receive the supply of a closure in the closure holding zone D at the time when the pull ring shaping and connecting means 16 receives a preshaped article in the pre-shaped article receiving zone C and arrives at the closure receiving zone E, there occurs the following problem in the bending zone F and the connecting zone G since uniting of the preshaped article and the closure cannot be done as shown in FIG. 2.

If the pull ring shaping and connecting means 16 receives only the pre-shaped article a pull ring is shaped alone in the bending zone F and the connecting zone G. In this case, no particular problem arises with regard to the apparatus itself in shaping a pull ring alone, but the pull ring maintained in the connecting means 16 up to shaping of the pull ring is not delivered to the closure transfer means 18 at the discharging zone H, but rather remains as it is.

As a result, the pull ring shaping and connecting means 16 arrives at the pre-shaped article receiving zone C and the closure receiving zone E in the state of holding the pull ring. Therefore, in the pull ring shaping and connecting means 16, an already-shaped pull ring, a pre-shaped article and a closure exist together in the mixed state. This may result in exertion of an excess force on the tool in the bending zone F and the connecting zone G and may cause damage or deformation, which may become the cause in trouble of the apparatus.

Also, when a shaped pull ring and a closure cannot be connected for some reason or other in the bending zone F and the connection zone G even at the time when the pull ring shaping and connecting means 16 receives a pre-shaped article in the pre-shaped article receiving zone C and receives a closure in the closure receiving zone G, the same problem as the above may occur with respect to a shaped pull ring.

In such a case, the closure is conveyed to the closure transfer means 18 and the connection strengthening means 20 in the discharging zone H, and no problem arises in the apparatus itself. However, since the closure obtained in such a manner is an inferior good, it must be detected and removed.

This invention, therefore, is characterized in that in order to prevent the apparatus from occurrence of such a trouble and an inferior good, a sensing means and a rejecting means are provided in each means which operates the pull ring shaping and connecting means.

With reference FIGS. 2 and 32 to 36, description in given regarding an embodiment of the sensing means and the rejecting means which form important parts of this invention.

Figure 32:
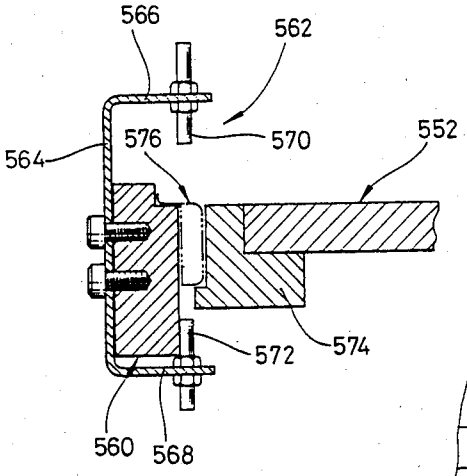
FIG. 32 is a sectional view of an essential part showing one embodiment of the sensing means which forms an important part of the apparatus of this invention.

FIG. 32 shows an embodiment of the sensing means. The sensing means in this embodiment is provided in the sensing zone L (FIG. 2) positioned downstream of the closure holding zone D as viewed in the rotating direction of the closure feed means 14 to sense the feeding condition of the closure connectingly fed to the pull ring shaping and connecting means 16. In FIG. 32, the reference mark 560 shows a stationary guide rail provided in the closure feed means 552, and a holding member 564 fixed to the outside surface of the stationary guide rail 560 to hold the watching unit 562. The watching unit 562 is constructed by fixing a light-projecting element 570 composed of a light-emitting diode, etc. and a light-receiving element 572 composed of a photocell, etc. respectively to the upper horizontal wall portion 566 and the lower horizontal wall portion 568. The light-projecting element 570 is positioned such that it projects light downwardly through the space between the outside surface of the closure receiving block 574 provided on the closure feed means 552 and the inner surface of the stationary guide rail 560, while the light-receiving element 572 is positioned such that it receives the light projected from the light-projecting element 570.

In the sensing unit 562 constructed as above, when the closure 576, is held by the closure receiving block 574 and is positioned between the light projecting element 570 and the light-receiving element 572, the light from the light-projecting element 570 is shielded by the closure 576, and the light-receiving element 572 is unable to receive the light from the light-projecting element 570.

Thus, when the closure-receiving blocks 574 which pass the watching zone L successively at predetermined intervals of time hold the closure 576, the closure 576 passing the watching zone L blocks off the light from the light-projecting element 570 and reception thereof in the light-receiving element 572, is discontinued at predetermined intervals of time. However, if a given block of the closure receiving block 574 does not hold the closure 576 therein, its passage through the watching zone L does not result in the blocking of the light from the light-projecting element 570, and therefore, the light-projecting element 572 continues to receive the light from the light-projecting element 570 over a longer period of time than the predetermined time interval. Therefore, if suitable signal generating circuit (not shown) is annexed to the light-receiving element 572 and the signal producing circuit operates to produce a required signal, when the light-receiving element 572 continues to receive the light from the light-projecting element 570 for a longer period of time than the predetermined time interval, the state of shut-off of the closure 576 supply can be easily detected.

Figure 33:
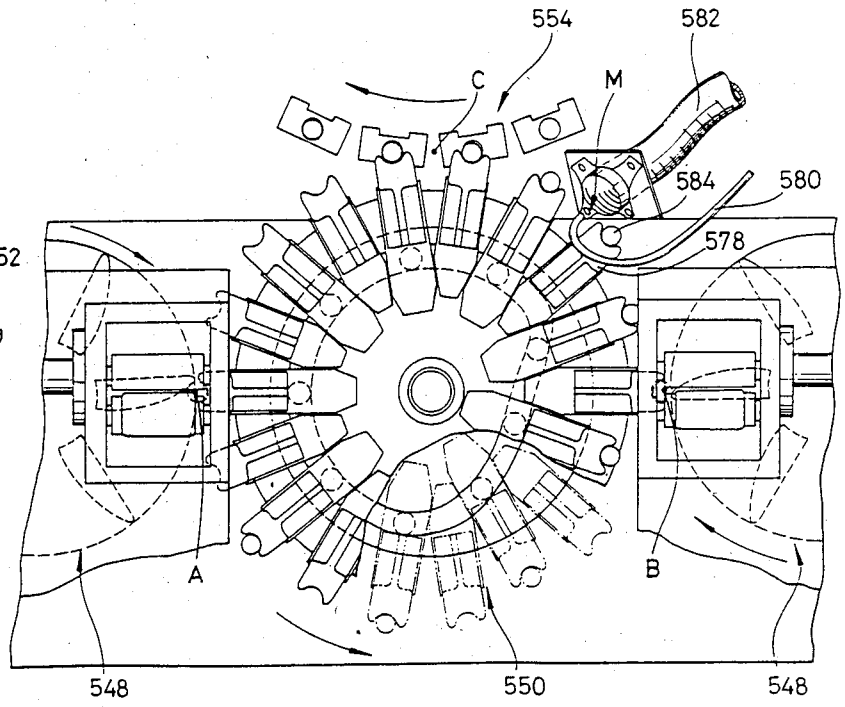
FIG. 33 is a diagram showing one embodiment of the rejecting means which forms an important part of the apparatus of this invention.
Figure 34:
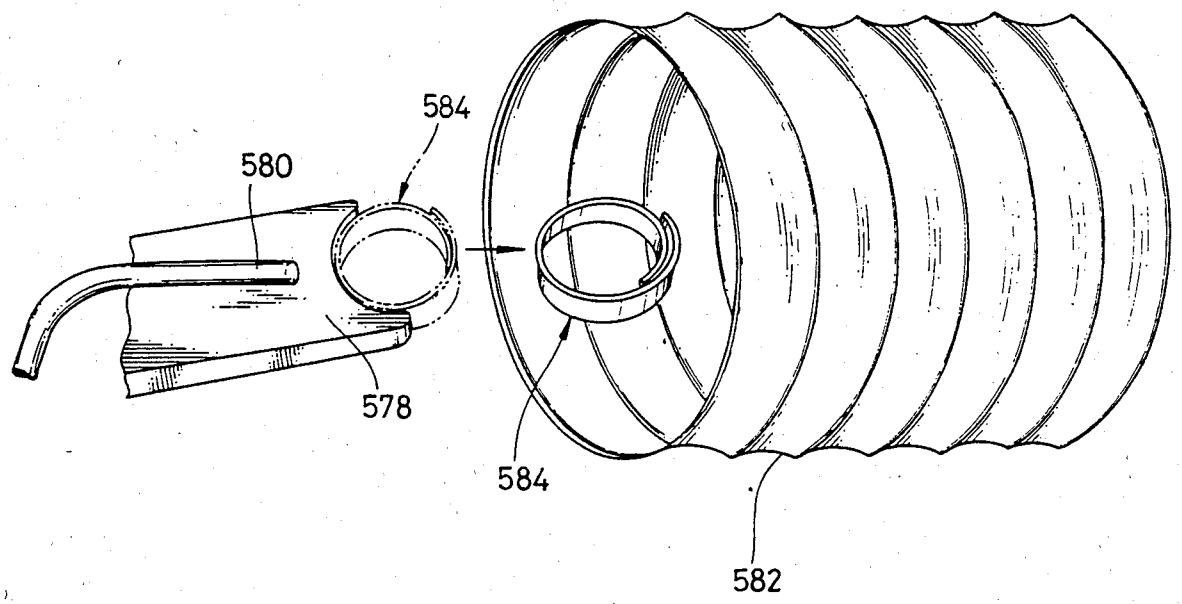
FIG. 34 is an enlarged perspective view of an essential part of the rejecting means shown in FIG. 33.

FIGS. 33 and 34 show one embodiment of the rejecting means. The rejecting means in this embodiment is provided in the rejecting zone M (FIG. 2) positioned upstream of the pre-shaped article receiving zone C as viewed in the rotating direction of the pre-shaped article feed means 550 to reject the pre-shaped article connectingly fed to the pull ring shaping and connecting means 554. In FIG. 33, the rejecting means in thus embodiment is comprised of an air stream jet nozzle directed to the end of the holding member 578 provided in the pre-shaped article feed means 550 and a collecting duct 582. As is clear from FIG. 34, the air stream jet nozzle 580 is directed in radial outward direction of the holding member 578 toward the pre-shaped article 584 magnetically attracted to and held by the end of the holding member 578. The air jet nozzle 580 is connected to a suitable compressed air source through a control valve (not shown) to be opened selectively. Accordingly, as shown in FIG. 33, when the control valve of the air stream jet nozzle 580 is opened at the time when the pre-shaped article 584 held in the holding member 578 of the pre-shaped article feed means 550 arrives at the rejecting zone M, and air jet stream is impinged from the nozzle 580 and the pre-shaped article 584 held at the end of the holding member 578 is forcibly removed and can be rejected into the collecting duct 582 (FIG. 34).

The sensing means and the rejecting means as described hereinbefore may have the following relation with an appropriate electronically controlled circuit. Namely, when the sensing means (FIG. 2) provided in the watching zone L of the closure feed means 14 detects a situation wherein a cap is not supplied it produce a predetermined detecting signal from the signal producing circuit, and a control valve of the rejecting means provided in the rejecting zone M of the pre-shaped article feed means 12 is opened responsive to the detected signal so that the pre-shaped article being in abutment with the closure supplied from the closure feed means 14 at the closure receiving zone E in the pull ring shaping and connecting means 16 may be removed before arrival at the pre-shaped article receiving zone C. Thus an undesired feed of the pre-shaped article alone to the bending zone F as well as the connecting zone G of the pull ring shaping and connecting means 16 may be prevended to avoid a possible occurrence of the problem as hereinbefore described.

Figure 35:
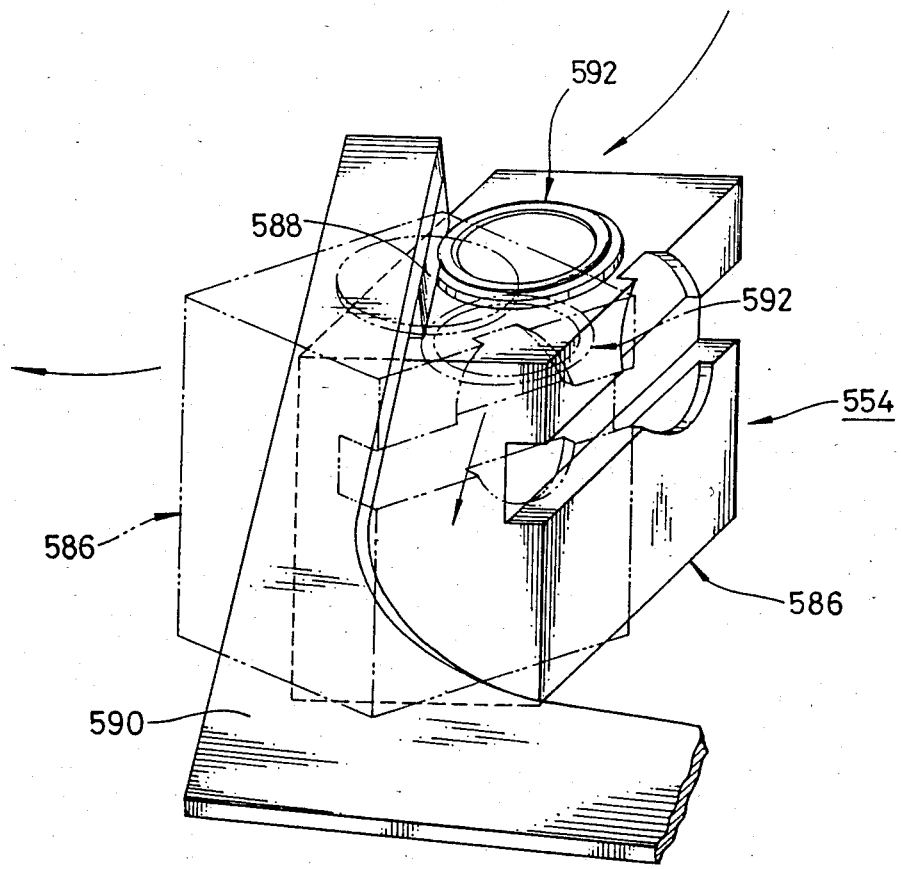
FIG. 35 is an enlarged perspective view of an essential part showing another embodiment of the rejecting means.

FIG. 35 shows another embodiment of the rejecting means. The rejecting means according to this embodiment is provided in the rejecting zone N (FIG. 2) positioned downstream of the discharging zone H and upstream of the pre-shaped article receiving zone C as viewed in the rotating direction of the pull ring shaping and connecting means 554 to reject the pull ring formed alone separate from the closure.

In FIG. 35, the rejecting means of this embodiment is comprised of an interfering member 588 arranged in the vicinity of an upper surface of an external member 586 and a stationary supporting plate 590 for hoding the interferring member 588. The interferring member 588 is provided in a free end portion of the stationary supporting plate 590 and directed to drop the formed pull ring 592 held on the upper surface of the external member 586 toward the radially outward face of the pull ring shaping and connecting means 554. Accordingly, the rejecting means thus constructed may securely reject the pull ring 592 retained even after passing the discharging zone H when the pull ring 592 alone is formed without being connected to the closure in the bending zone F and the connecting zone G of the pull ring shaping and connecting means 554. It is preferable if it is constructed to suitably collect the rejected pull ring 592 into a collecting vessel.

Figure 36:
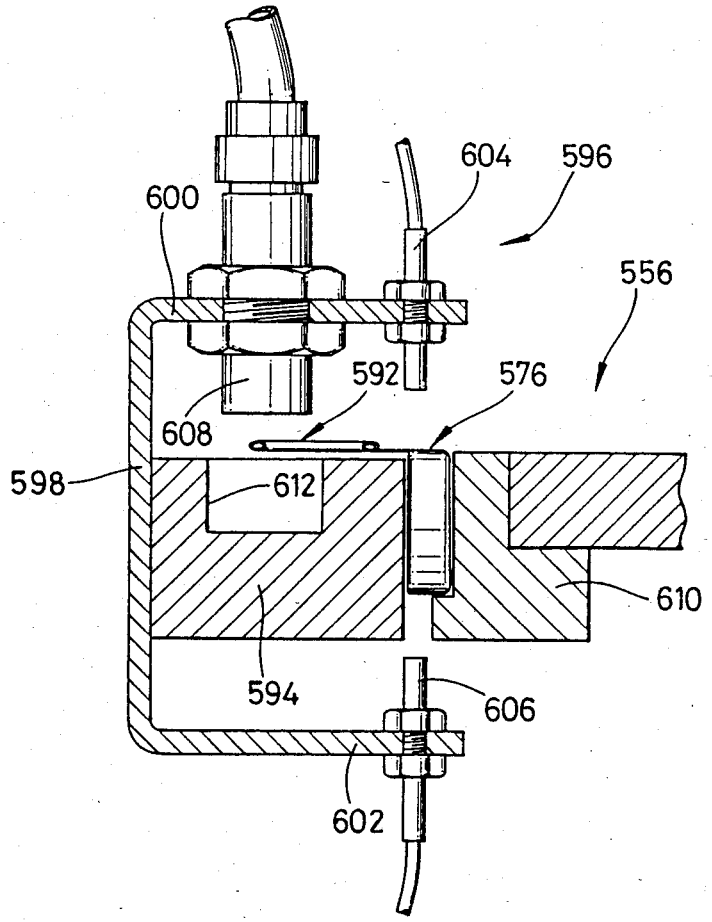
FIG. 36 is a sectional view of an essential part showing another embodiment of the sensing means.

FIG. 36 shows another embodiment of the sensing means. The sensing means in this embodiment is to be provided in the sensing zone O (FIG. 2) positioned downstream of the discharging zone H as viewed in the rotating direction of the container closure transfer means 556 to sense whether the connection between the pull ring and the closure is correctly performed simultaneously with shaping of the pull ring in the pull ring shaping and connecting means 16.

In FIG. 36, the reference mark 594 shows the stationary guide rail provided in the closure transfer means 556. A holding member 598 to hold the sensing unit 596 is fixed to the outside surface of the stationary guide rail. The sensing unit 596 is constructed such that a light-projecting element 604 composed of a light-emitting diode, etc. and a light receiving element 606 composed of a photocell, etc. are fixed respectively to the upper horizontal wall portion 600 and the lower horiziontal wall portion 602 projecting radially inwardly of the holding member 598, and a detector 608 composed of a reed switch, etc. is fixed to the upper horizontal wall portion 600. The light-projecting element 604 is positioned so as to project the light downwardly through the space between the outside surface of the closure receiving block 610 provided in the closure transfer means 556 and the inner surface of the stationary guide rail 594, while the light-receiving element 606 is positioned to receive the light from the light-projecting element 604. The detector 608 is positioned opposite to the upper surface of the stationary guide rail 594 which is adjacent to the closure receiving block 610 to detect the existence of the pull ring connected to the closure 576 passing therethrough. In this case, a cut 612 is provided on the stationary guide rail 594 with respect to the detector 608 so as not to effect the detector 608.

Accordingly, in the sensing unit 596, when the closure 576 with a pull ring connected thereto is held in the closure receiving block 610 and is positioned between the light-projecting element 604 and the light-receiving element 606, receiving of the light from the light-projecting element 604 in the light-receiving element 606 is shielded at the predetermined time interval, the same as the embodiment shown in FIG. 32, while when the closure 576 is not held in the closure receiving block 610, the light-receiving element 606 continues to receive the light from the light-projecting element 604 over a longer period of time than the predetermined time interval.

On the other hand, the detector 608 performs the detecting operation when the pull ring 592 arriving in with the closure 576 exists contrary to the detecting operation of the light-receiving element 606. For example, when the closure 576 lacks the pull ring 592 and is transferred, the detector 608 does not perform the detecting operation although the detector 608 should detect originally when the light-receiving element does not receive the light from the light-projecting element 604. In such a case, it is convenient to arrange that by producing a signal to stop the operation of the apparatus by means of a suitably provided signal producing circuit (not shown), the cause of lacking the pull ring 592 in the pull ring shaping and connecting means 554 is detected.

ADVANTAGE OF THE INVENTION

As is clear in the above description, in this invention, it is possible to form a pre-shaped article at high speed and accurately by the pre-shaped article forming means constructed in the above mentioned way. Accordingly, as mentioned above, the pre-shaped article is fed to the pull ring shaping and connecting means through the pre-shaped article feeding means, and simultaneously the pull ring is shaped and connected to the container closure through the container closure feed means. Thereafter, the pull ring and the container closure are fed to the connection strengthening means through the container closure transfer means where the operation of pressing and deforming of the connected part between the pull ring and the container closure is performed, thus mass production of a container closure equipped with a metallic pull ring having stable quality at low cost is made possible.

Furthermore, in this invention, it is possible quickly and accurately to hold the pre-shaped article to be formed at a high speed by the pre-shaped article forming means at a definite position and to convey it to the pull ring shaping and connecting means. Accordingly, it is possible to perform mass production of a container closure equipped with a metallic pull ring of stable quality at low cost by the process that the pre-shaped article so conveyed is fed to the pull ring shaping and connecting means and that shaping and connecting of pull ring is performed with the container closure fed through the container closure feed means and after that is fed to the connection strengthening means through the container closure transfer means where pressing and deforming of the connected portion between the pull ring and the container closure is performed.

Furthermore, in this invention, it is possible to hold at a definite position the container closure to be connected to the pre-shaped article quickly and accurately conforming to the timing of conveying the pre-shaped article formed at high speed by the pre-shaped article forming means to the pull ring shaping and connecting means, and to convey the closure to the pull ring shaping and connecting means. The container closure so conveyed undergoes the process of pull ring shaping and connecting together with the pre-shaped article fed through the pre-shaped article feed means at the pull ring shaping and forming means, and after that the closure is fed through the container transfer means to the connection strengthening means for pressing and deforming the connected part between the pull ring and the closure. Thus, mass production of a container closure equipped with a metallic pull ring of stable quality at low cost is possible.

Moreover, in this invention, it is possible accurately to hold the pre-shaped article connectingly fed from the pre-shaped article feed means and the closure connectingly fed from the closure feed means at a predetermined timing and a predetermined position and to perform a connecting process between the pull ring and the closure simultaneously with shaping of the pull ring at high speed. Accordingly, the closure formed and connected in such a manner is fed to the connection strengthening means through the closure transfer apparatus where press deformation of the connected part between the pull ring and the closure is performed, whereby mass production of the container equipped with a metallic pull ring of stable quality at low cost is made possible.

Furthermore, in this invention, while a pre-shaped article connectingly fed from the pre-shaped article feed means and a container closure connectingly fed from the closure feed means are being kept at a predetermined timing and a predetermined position, connection between the pull ring and the container closure is performed simultaneously with shaping of the pull ring, and, holding the closure obtained in this manner, it is possible to perform transfer of the closure stably and quickly to the means of strengthening the connected part between the pull ring and the closure. Therefore, the closure transferred in this manner is fed to the connection strengthening means, and by pressing and deforming the connected part of the container between the pull ring and the closure, mass production of a container closure equipped with a metallic pull ring of a stable quality at low cost can be done.

Furthermore, in this invention, while a pre-shaped article connectingly fed from the pre-shaped article feed means and a container closure connectingly fed from the closure feed means are being kept at a predetermined timing and a predetermined position, connection between the pull ring and the container closure is performed simultaneously with shaping of the pull ring, and it is possible to perform the process of press deformation to strengthen the connected part between the container closure and the pull ring obtained as above both stably and quickly.

Therefore, in the pull ring shaping and connecting apparatus providing the connection strengthening means constructed in the above mentioned manner, mass production of a container closure equipped with a metallic pull ring of a stable quality at low cost may be attained.

Moreover, in this invention, by providing the sensing zone in the closure feed means which connectingly feeds the closure and disposing therein the sensing means of the closure and by providing the rejecting zone in the pre-shaped article feed means which connectingly feeds the pre-shaped article and disposing therein the rejecting means of the pre-shaped article, it is possible to reject the pre-shaped article fed in conformity to the feed of the closure at the time when the feed of the closure to the pull ring shaping and connecting means is shut off, thus to avoid shaping of a defective pull ring and to accomplish the continued safe operation of the apparatus as well. Also, by providing the sensing zone in the transfer means of the closure equipped with a pull ring which was connected to the closure simultaneously with the shaping of the pull ring and disposing therein the sensing means of the closure and the pull ring, and further by providing the rejecting zone in the pull ring shaping and connecting means and disposing therein the rejecting means of the pre-shaped article, it is possible to detect the trouble of the apparatus by detecting the closure lacking the pull ring and to maintain safe operation of the apparatus by rejecting the shaped ring which was not connected in the pull ring shaping and connecting means. Accordingly, in the pull ring shaping and connecting apparatus provided with the sensing means and the rejecting means constructed as above, it is possible safely to perform manufacturing of the container closure equipped with the metallic pull ring of stable quality at low cost and easily to realize mass production thereof.

Although the preferred embodiments of the invention have been described hereinabove, the invention may be varied and modified in many ways without departing from the scope and the spirit of the invention.

We claim:

1. An apparatus for shaping a metallic pull ring and simultaneously connecting it to a container closure comprising:

a rotary pull ring shaping and connecting means for curling the peripheral edge of the pre-shaped article in the radial direction to form it into a ring and simultaneously rolling a tear-off tab of the closure into said ring and connecting them to each other said pull ring shaping and connecting means comprising a pre-shaped article receiving zone, a closure receiving zone, a rolling zone comprising a bending zone and a pull ring shaping and connecting zone, and a discharge zone; at least one rotary pre-shaped article forming means for shearing a rectangular metal blank from the end portion of a thin metal strip and simultaneously bending it to form an annular pre-shaped article having overlapped opposite ends, said forming means comprising a rotary shearing blade; a rotary pre-shaped article feed means positioned intermediate and adjacent said pull ring shaping and connecting means and said pre-shaped article forming means for rotary transfer of said article from said at least one rotary pre-shaped article forming means to said pre-shaped article receiving zone of said rotary pull ring shaping and connecting means; and a rotary closure feed means positioned adjacent said pull ring shaping and connecting means for rotary transfer of said closure to said closure receiving zone of said pull ring shaping and connecting means and for positioning of said closure and said preshaped article at said closure receiving zone such that the free end portion of a tear-off tab of the closure and a part of the pre-shaped article overlap each other.

2. An apparatus as claimed in claim 1, wherein the pre-shaped article forming means comprises a metal strip feeding means for intermittently feeding the thin metal strip in its longitudinal direction by a distance corresponding to the width of the rectangular metal blank to be sheared, a stationary shearing tool having a single stationary shearing blade perpendicular to said strip located at a predetermined shearing distance from said feeding means in the direction of feed, a movable shearing tool having a plurality of shearing blades, a rotating support member having an axis parallel to the feed direction and on which said blades are fixed at predetermined intervals in the circumferential direction, said rotary shearing blades cooperating with the stationary shearing blade for shearing the longitudinally forward end portion of the thin metal strip from one side edge to the other side edge and simultaneously bending it in the widthwise direction.

3. An apparatus as claimed in claim 1, wherein the pre-shaped article feed means comprises a rotary support member and a plurality of holding members circumferentially spaced at predetermined intervals on and fixed to the rotating support member, each of said holding members having a radially outward end portion comprising a recess comprising a holding means for holding the pre-shaped article; and a pre-shaped article holding zone in which the pre-shaped article is received from the pre-shaped article forming means.

4. An apparatus as claimed in claim 3, wherein the rotating support member of the pre-shaped article feed means is adapted to rotate about a substantially vertical axis.

5. An apparatus as claimed in claim 3, wherein the holding means provided in the holding member of the pre-shaped article feed means is a magnet which attracts and holds the pre-shaped article made of a magnetic metal by the action of a magnetic force.

6. An apparatus as claimed in claim 3, wherein the holding means provided in the holding member of the pre-shaped article feed means is a suction holding means for holding the pre-shaped article by a vacuum action.

7. An apparatus as claimed in claim 3, wherein the pre-shaped article feed means comprises means located at the end of each of said plurality of holding members for receiving and holding the outside surface of that portion of the pre-shaped article which is other than the overlapping end portions.

8. An apparatus as claimed in claim 1, wherein the closure feed means compises a closure holding zone, a rotating conveyor disc adapted to rotate about a substantially vertical axis comprising a plurality of circumferentially spaced closure receiving pockets formed on the peripheral surface of said conveyor disc and opened radially outwardly and vertically upwardly; a closure feed chute for feeding the closure into each of said pockets from above in a vertical direction in a closure holding zone, and an arcuate stationary guide rail extending along the peripheral surface of the rotating conveyor disc over a range at least from the closure holding zone to the closure receiving zone of the pull ring shaping and connecting means; said closure feed chute having an open groove for feeding and guiding the closure while allowing the outside surface of the top panel wall of the closure to abut against the rear wall of the chute and positioning the tear-off tab uppermost in the vertical direction; and the stationary guide rail having an inner surface with which the lower edge of the skirt wall of the closure received in the pocket makes contact and a top surface with which the inner surface of the base portion of the tear-off tab makes contact.

9. An apparatus as claimed in claim 8, wherein the closure feed chute of the closure feed means comprises a pin projecting into the skirt wall of the closure to prevent the downward movement of the closure, said pin being movable with respect to said open groove provided in the central portion of its front wall.

10. An apparatus as claimed in claim 1, wherein the pull ring shaping and connecting means comprises a rotating support member adapted for continuous rotation and a plurality of pull ring shaping and connecting units circumferentially spaced at predetermined intervals on the rotating support member such that each of the pull ring shaping and connecting units is conveyed by the rotation of the rotating support member successively through said pre-shaped article receiving zone, closure receiving zone and rolling zone, the pre-shaped article being fed to the pull ring shaping and connecting unit in said pre-shaped receiving zone, the closure being fed to the pull ring shaping and connecting unit in said closure receiving zone, and the curling and rolling connection being carried out in said rolling zone.

11. An apparatus as claimed in claim 10, wherein each of the pull ring shaping and connecting units comprises a vertical mandrel comprised of a lower mandrel member and an upper mandrel member disposed in coaxial alignment, at least one of the lower and upper mandrel members being free to move up and down; and wherein in the pre-shaped article receiving zone, the pre-shaped article is conveyed by the pre-shaped article feed means to the space between the upper mandrel member and the lower mandrel member spaced vertically from each other; and means associated with the pull ring shaping and connecting units for lowering the upper mandrel member and raising the lower mandrel member, the pre-shaped article being positioned over the vertical mandrel.

12. An apparatus as claimed in claim 11, wherein the upper mandrel member has a cylindrical main portion and a nearly conical upper end portion, the outside diameter of the main portion of the upper mandrel member being substantially equal to that of the main portion of the lower mandrel member and the lower end portion of the upper mandrel member and the upper end portion of the lower mandrel member having complementary cuts formed therein such that when the upper mandrel member is lowered and/or the lower mandrel member is raised, the main portion of the uppr mandrel member is combined with the main portion of the lower mandrel member to form a substantially continuous cylindrical vertical mandrel.

13. An apparatus as claimed in claim 11, wherein each pull ring shaping and connecting unit has an upper annular rolling tool and a lower annular rolling tool coaxial with said vertical mandrel which are free to move up and down such that before the pull ring shaping and connecting unit reaches the closure receiving zone after passage through the pre-shaped article receiving zone, the upper annular rolling tool is lowered to a predetermined position to lower the lower edge of the pre-shaped article put over the vertical mandrel to a position at which it abuts against the lower annular rolling tool, and after passage through the closure receiving zone, the upper annular rolling tool is lowered to deform the pre-shaped article and the free end portion of the tear-off tab of the closure simultaneously in cooperation with the lower annular rolling tool.

14. An apparatus as claimed in claim 10, wherein each of the pull ring shaping and connecting units comprises a hammer means which, after each said pull ring shaping and connecting unit has passed through the closure receiving zone and before it enters the rolling zone, presses the free end portion of the tear-off tab against the surface of the vertical mandrel and a part of the pre-shaped article overlapping said free end portion of the tear-off tab, thereby bending the free end portion of the tear-off tab in its widthwise direction to a curvature substantially equal to the curvature of the pre-shaped article in its longitudinal direction.

15. An apparatus as claimed in claim 1, and a closure transfer means located adjacent said pull ring shaping and connecting means comprising a transfer zone for rotary transfer of a closure having the pull ring connected to the free end portion of the tear-off tab from said pull ring shaping and connecting means at the said discharge zone.

16. An apparatus as claimed in claim 15, and connection strengthening means for pressing and deforming the connected portion between the pull ring and the free end portion of the tear-off tab of the closure to strengthen their connection and further said connection strengthening means transferring said connected pull ring and closure from aid closure transfer means at said closure transfer zone.

17. An apparatus as claimed in claim 16, wherein the connection strengthening means comprises a rotating support member rotatable about a substantially vertical axis and a plurality of connection strengthening units fixed to and spaced circumferentially at predetermined intervals on the rotating support member, each of said connection strengthening units comprising a supporting block having a radially outwardly and vertically upwardly opened pocket for receiving the closure and the pull ring connected to it, and an upper pressing tool and a lower pressing tool cooperating in vertical alignment such that the connected part between the closure and the pull ring in the pocket is pressed and deformed by the cooperation of the upper and lower pressing tools.

18. An apparatus as claimed in claim 15, wherein the closure transfer means comprises a rotatable transfer disc rotatable about a substantially vertical axis, a plurality of closure receiving pockets opened radially outwardly and vertically upwardly fixed to and spaced circumferentially on the peripheral surface of the rotating transfer disc at predetermined intervals, and a stationary guide rail extending along the peripheral surface of the rotating transfer disc at least over a range from the discharging zone of the pull ring shaping and connecting means to the transfer zone of the connection strengthening means, the stationary guide rail having an inner surface with which the lower edge of the skirt wall of the closure having the pull ring connected thereto and received in said pocket makes contact and a top surface with which the base portion of the tear-off tab and the radially inside portion of the pull ring make contact.

19. An apparatus as claimed in claim 1, and: a sensing means for detecting the failure of feeding the closure provided at a part of the closure feed means preceding said closure receiving zone in the direction of feed and a rejecting means for rejecting the pre-shaped article provided at a part of the pre-shaped article feed means preceding said pre-shaped article receiving zone; such that in the event that a certain pull ring shaping and connecting unit in the pull ring shaping and connecting means should fail to receive the closure owing to the non-conveyance of the closure by the closure feed means to the closure receiving zone, the rejecting means is actuated to keep the pre-shaped article from being conveyed to the pre-shaped article receiving zone and thus make said certain pull ring shaping and connecting unit unable to receive the pre-shaped article receiving zone.

20. An apparatus as claimed in claim 19, and a rejecting means for rejecting an independently shaped pull ring provided in a part of the pull ring shaping and connecting means between said discharge zone and said pre-shaped article receiving zone.

21. An apparatus as claimed in claim 19, and a sensing means for simultaneously detecting the closure and the pull ring connected to it located downstream from said discharge zone.

* * * * *